US006738593B2

(12) United States Patent
Kawamura et al.

(10) Patent No.: US 6,738,593 B2
(45) Date of Patent: May 18, 2004

(54) DEVELOPING DEVICE WITH DEVELOPER BEARING MEMBER OVERLYING DEVELOPER CONTAINING CHAMBER

(75) Inventors: Takeshi Kawamura, Shizuoka (JP); Tetsuya Sano, Shizuoka (JP); Ken Nakagawa, Shizuoka (JP); Hikaru Osada, Shizuoka (JP); Shuji Moriya, Shizuoka (JP); Kenji Kanari, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/206,975

(22) Filed: Jul. 30, 2002

(65) Prior Publication Data

US 2003/0026629 A1 Feb. 6, 2003

(30) Foreign Application Priority Data

Jul. 31, 2001 (JP) ..... 2001-231112
Jul. 31, 2001 (JP) ..... 2001-231113
Oct. 30, 2001 (JP) ..... 2001-332281

(51) Int. Cl.[7] ..... G03G 15/08
(52) U.S. Cl. ..... 399/281; 399/283; 399/284
(58) Field of Search ..... 399/281, 284, 399/288, 283, 272, 278, 274

(56) References Cited

U.S. PATENT DOCUMENTS 3,376,852 A * 4/1968 Weiler ..... 399/288
5,652,075 A * 7/1997 Kanbayashi et al. .... 399/284 X
5,682,585 A 10/1997 Yamaguchi et al. ..... 399/274
5,689,782 A * 11/1997 Murakami et al. ..... 399/281
5,899,609 A * 5/1999 Wang ..... 399/281

FOREIGN PATENT DOCUMENTS

JP 5-61334 3/1993

OTHER PUBLICATIONS

U.S. patent application Ser. No. 10/011,411, filed Dec. 11, 2001, pending.

* cited by examiner

*Primary Examiner*—William J. Royer
(74) *Attorney, Agent, or Firm*—Fitzpatrick, Cella, Harper & Scinto

(57) ABSTRACT

A developing device including a housing, a developer bearing member rotatably provided in an opening portion of the housing, a developer containing chamber, and a developer supplying and removing member being in contact with the developer bearing member, and having the function of supplying a developer in the developer containing chamber to the developer bearing member and the function of removing the developer from the developer bearing member, wherein the developer bearing member is disposed above the developer containing chamber, and the developer supplying and removing member has the function of upwardly carrying the developer in the developer containing chamber.

4 Claims, 28 Drawing Sheets

DIRECTION
OF GRAVITY

FIG. 28

| ARRANGEMENT OF DEVELOPING DEVICE | ROTATING SPEED OF DT ROLLER, DEVELOPING ROLLER [ rpm ] | | |
|---|---|---|---|
| | 30 | 50 | 70 |
| 27A | ○ | × | × |
| 27B | ○ | × | × |
| 27C EIGHTH EMBODIMENT | ○ | ○ | ○ |

○ ··· TONER LEAKAGE DOES NOT OCCUR
× ··· TONER LEAKAGE OCCURS

DEVELOPING DEVICE WITH DEVELOPER BEARING MEMBER OVERLYING DEVELOPER CONTAINING CHAMBER

BACKGROUND OF THE INVENTION

1. Field of the Invention

This invention relates to a developing device for use in an image forming apparatus such as a copying machine or a printer using a recording method of the electrophotographic type or the electrostatic recording type.

2. Description of Related Art

FIG. 9 of the accompanying drawings is a schematic cross-sectional view of a printer of the electrophotographic type.

A usually drum-shaped electrophotographic photosensitive member 150 (hereinafter referred to as the photosensitive drum 150) as a latent image bearing member is uniformly charged by a primary charger 151. Next, light is applied from an exposing device 152 onto the photosensitive drum 150 correspondingly to image information inputted from an external device to thereby form a latent image. This electrostatic latent image on the photosensitive drum 150 is made into a visible image, i.e., a toner image, by a developing device 160 by a developer T (hereinafter referred to as the toner) having the same triboelectrification polarity as the voltage applied from the primary charger 151. The toner image is transferred to a transferring material P by a transferring charger 153. The transferring material P is separated from the photosensitive drum 150 and subsequently is conveyed to a fixing device 155, and the toner image thereon is fixed thereby and thereafter becomes a permanent image. Also, any toner T not transferred by the transferring charger 153 but remaining on the photosensitive drum 150 is removed by a cleaning device 154, and the photosensitive drum 150 is used for the next image forming process.

The nonmagnetic monocomponent developing device 160 will be described here in detail with reference to FIGS. 10A and 10B of the accompanying drawings. The construction of the nonmagnetic monocomponent developing device 160 will first be shown.

In the nonmagnetic monocomponent developing device 160, generally gravity is utilized (FIG. 10A) or an agitating member is used (FIG. 10B) to carry a sufficient toner T to a developing portion having a developing roller 161 as a developer bearing member and a roller 162 (hereinafter referred to as the RS (remove and supply) roller) for supplying and removing the toner T onto and from the developing roller 161. Accordingly, the positional relationship between the developing portion and a toner containing portion becomes such that the developing portion is disposed downwardly of the toner containing portion or at a horizontal position with respect to the direction of gravity.

The toner containing portion has the toner T which is an insulative monocomponent developer and an agitating member 164. In this example, the toner T is of a negatively chargeable property and is a negatively chargeable nonmagnetic toner containing a pigment of one of yellow, magenta, cyan and black colors. As regards the agitating member 164 (FIG. 10B), a first toner agitating member 164 and a second toner agitating member 165 each comprising a plate worked into one of various shapes or a screw or the like are rotated to thereby carry the toner T in the toner containing portion to the developing roller 161. The number of the agitating members need not be two, but may be any number if they can carry the toner T from the end portion of a developing container to the vicinity of the developer bearing member 161 in accordance with one of the various constructions of the developing device 166.

In FIG. 10B, a developing container partition plate 166 is formed with a proper height so that a constant amount of toner may always be supplied onto the RS roller 162 near the developing roller 161.

In the nonmagnetic monocomponent developing method, the supply of the toner T by a magnetic force becomes impossible and therefore, the RS roller 162 made of urethane sponge is brought into contact with the developing roller 161. The RS roller 162 is rotated in a counter direction at the nip portion with the developing roller 161 to thereby supply the toner T onto the developing roller 161 and at the same time, removes the toner T on the developing roller 161 which has not been used for development even if it has passed the position opposed to the photosensitive drum 150.

A regulating blade 163 made of an elastic material such as urethane rubber as a toner amount regulating member (layer thickness regulating member) abuts against the developing roller 161 to thereby regulate the toner T on the developing roller 161 and form a thin toner layer, and prescribes the amount of toner T to be carried to a developing area (the position opposed to the photosensitive drum 150). The amount of toner T carried to the developing area is determined by the abutment pressure, the abutment length of the regulating blade 163 contacting with the developing roller 161.

The regulating blade 163 is adhesively secured or welded onto a thin metal plate of phosphor bronze, stainless!steel or the like having a thickness of several hundreds of $\mu$m, and the regulating blade 163 is a chip blade made to uniformly abut against the developing roller 161 by the resiliency of the thin metal plate. At this time, the abutment condition of the regulating blade 163 is determined by the material, thickness, amount of entry and set angle of the thin metal plate.

The toner T carried to the developing area, as in the aforedescribed magnetic monocomponent developing method, adheres to the latent image on the photosensitive drum 150 to thereby visualize the latent image as a toner image.

According to the above-described monocomponent developing method, it becomes possible to form a thin toner layer suited for development by a simple construction and therefore, the downsizing and simplified maintenance of the electrophotographic apparatus are possible.

The above-described monocomponent developing device 160, however, has suffered from the problem that as image outputting is repeated for a long period of time, image density lowers and the dot reproducibility of halftone image portions lowers.

A main factor which gives rise to the above-noted problem is the deterioration of the toner T. The deterioration of the toner T refers to the aggravation of the developing characteristic such as a reduction in the chargeability of the toner T and an increase in the agglutinability of the toner T caused by an extraneous additive present on the surface of the toner T being embedded in a toner T binder.

The cause of the above-described deterioration of the toner T will be described below.

In the monocomponent developing device 160, the main cause of the deterioration of the toner T is what is called frictional contact deterioration. As described in the conventional art, in the monocomponent developing method, the photosensitive drum 150 and the developing roller 161, the developing roller 161 and the regulating blade 163, and the developing roller 161 and the RS roller 162 are brought into contact with each other with predetermined pressure with a view to output images of high quality. When the toner T passes between these, the values of physical properties including chargeability are changed by stress and frictional heat. Here, it is said that the temperature to which the toner T rises by frictional heat when it passes the developer regulating blade 163 reaches several tens of centigrade degrees or higher regarding a microscopic area called the surface of the toner T.

Also, when the circulation of the toner T in the developing device 160 is bad, the deterioration of the toner T is promoted. When the toner T once passed between the photosensitive drum 150 and the developing roller 161 and removed by the RS roller 162 is immediately supplied again to the developing roller 161 by the RS roller 162, the surface temperature of the toner T rises further by the influence of continuous stress and frictional heat and at last, it locally fuses the surface of the toner T to thereby promote the deterioration of the toner T.

As shown in the conventional art, it is popular in the construction of the conventional developing device 160 in the monocomponent developing method that the toner containing portion is upward of the developing portion constituted by the RS roller 162 and the developing roller 161 with respect to the direction of gravity, or horizontal. In these constructions, the toner T is always carried from the toner containing portion to the developing portion, which thus becomes full of the toner T. As a result, the toner T removed from the developing roller 161 exists near the RS roller 162, and exists on a toner removing path formed by the driving force of the RS roller 162 and therefore, the toner T is supplied again to the developing roller 161 before the surface of the toner T is sufficiently cooled, and as described above, the temperature of the toner T has risen and the deterioration of the toner T has occurred.

Also, in the construction of the developing device 160 shown in the conventional art, the developing portion becomes full of the toner T, whereby there also arise such problems as the blow-off of the toner T from the developing device 160, the packing phenomenon that fluidity is extremely lowered by the pressure of the weight of the toner T, and an increase in the torque of the driving of the developing roller 161 resulting from the packing phenomenon.

If conversely, the developing portion is disposed above the toner containing portion with respect to the direction of gravity, it is considered that it will not happen that as described above, the developing portion is clogged with the toner T and the circulation of the toner T becomes bad. However, in the conventional toner carrying method, it becomes very difficult to carry a necessary sufficient amount of toner T from the developer containing portion to the developing portion. It is because the toner T must be drawn up against gravity.

SUMMARY OF THE INVENTION

The present invention has been made in view of the above-noted problems and an object thereof is to provide a developing device in which it is difficult for a toner to be deteriorated.

Another object of the present invention is to provide a developing device in which it is difficult for a toner to be deteriorated and the supply of the toner to a developing roller is stable.

In one aspect, the present invention provides a developing device comprising a housing, a developer bearing member, a developer containing chamber, and a developer supplying and removing member. The developer bearing member is rotatably provided in the opening portion of the housing.

The developer supplying and removing member has the function of supplying a developer in the developer containing chamber to the developer bearing member and the function of removing the developer from the developer bearing member. The developer bearing member is disposed above the developer containing chamber, and the developer supplying and removing member has the function of upwardly carrying the developer in the developer containing chamber.

In another aspect, the present invention provides a developing device comprising a housing, a developer bearing member and a developer containing chamber. The developer bearing member is rotatably provided in the opening portion of the housing. The developer bearing member has the function of carrying the developer upwardly from within the developer containing chamber.

Further objects of the present invention will become apparent from the following detailed description when read with reference to the accompanying drawings.

BRIEF DESCRIPTION OF THE DRAWINGS

FIG. 28 is a table showing the result of an experiment in which the effect of the present embodiment was confirmed.

DETAILED DESCRIPTION OF THE PREFERRED EMBODIMENTS

First Embodiment

Figure 1:
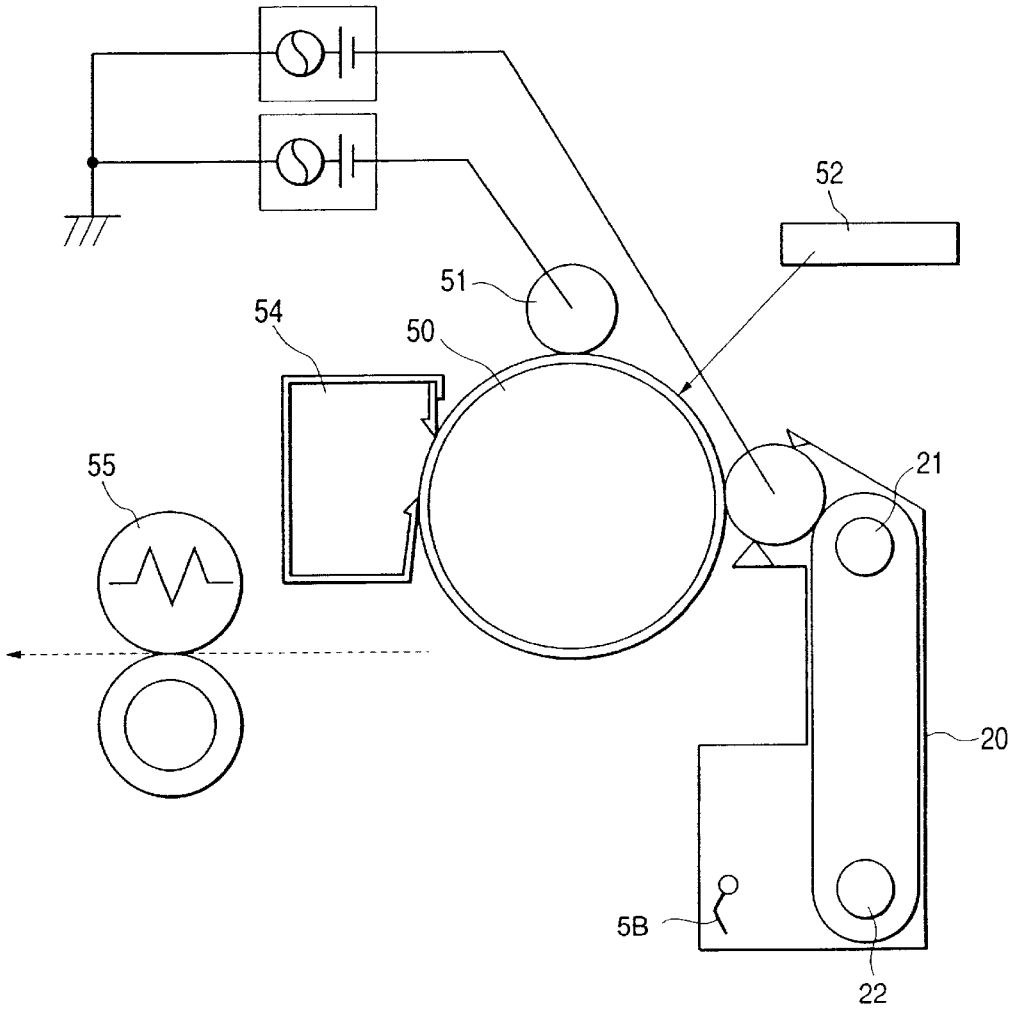
FIG. 1 schematically shows the construction of an electrophotographic apparatus according to a first embodiment.
Figure 3A:
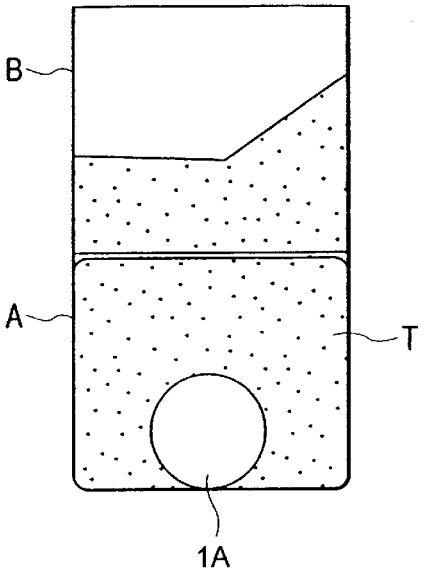
FIGS. 3A, 3B and 3C are model views showing developing portions, toner containing portions, toner containing states and toner carrying states in three types of developing devices having different carrying means.
Figure 3B:
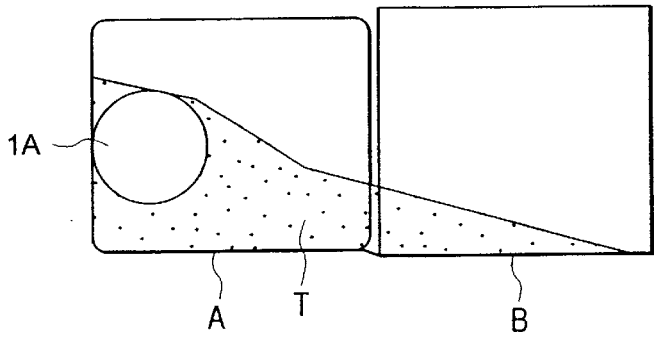
Figure 3C:
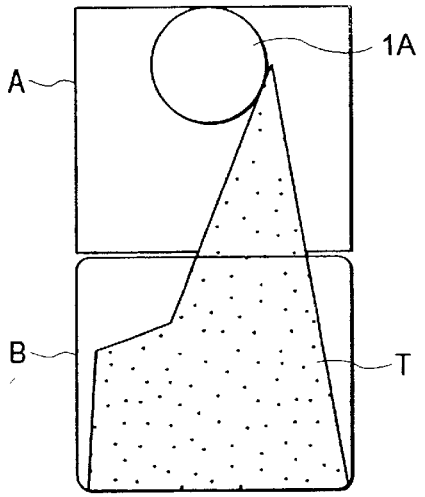
Figure 4:
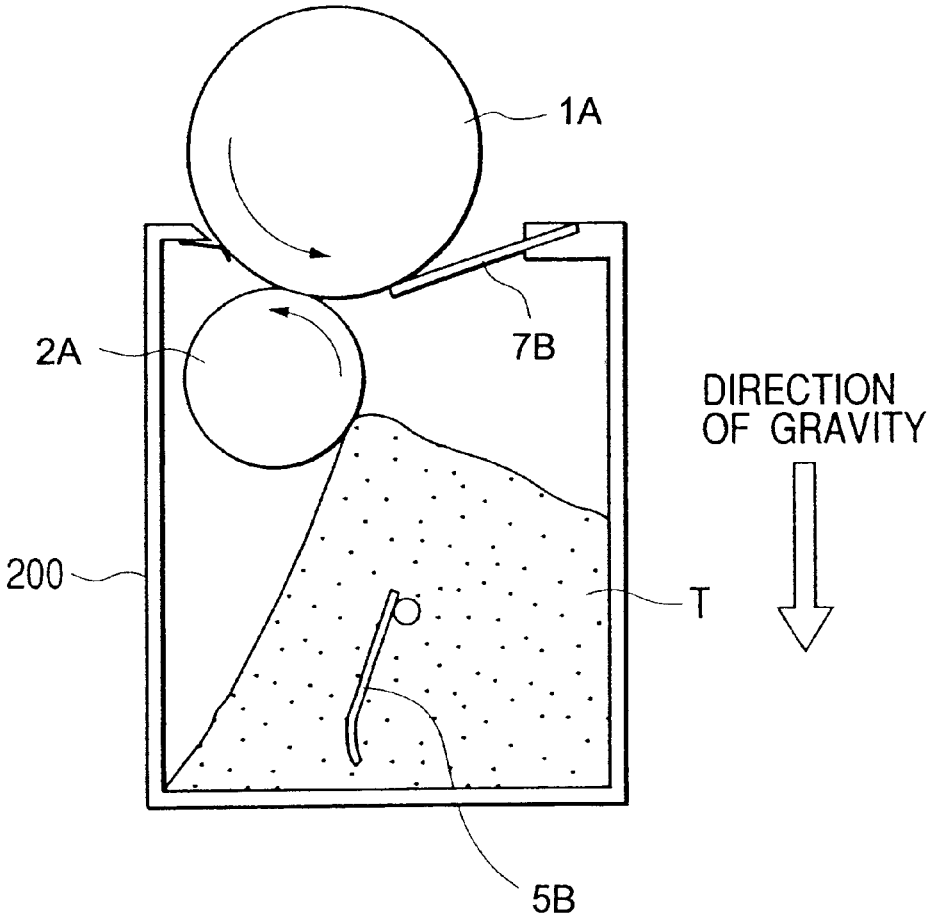
FIG. 4 shows the construction of a developing device using draw-up carrying means other than a belt.
Figure 5:
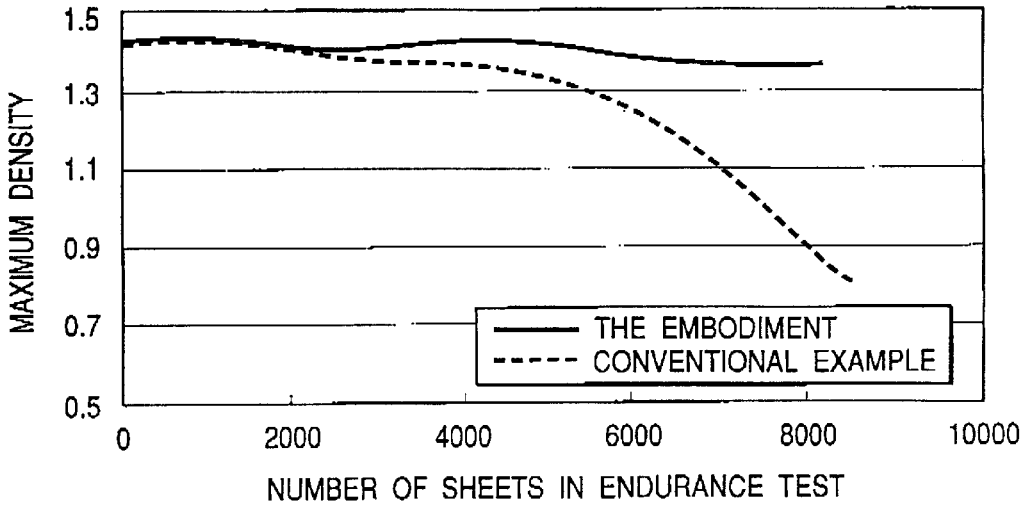
FIG. 5 shows the dependency of the maximum density on the number of sheets in an endurance test in the developing device.
Figure 6:
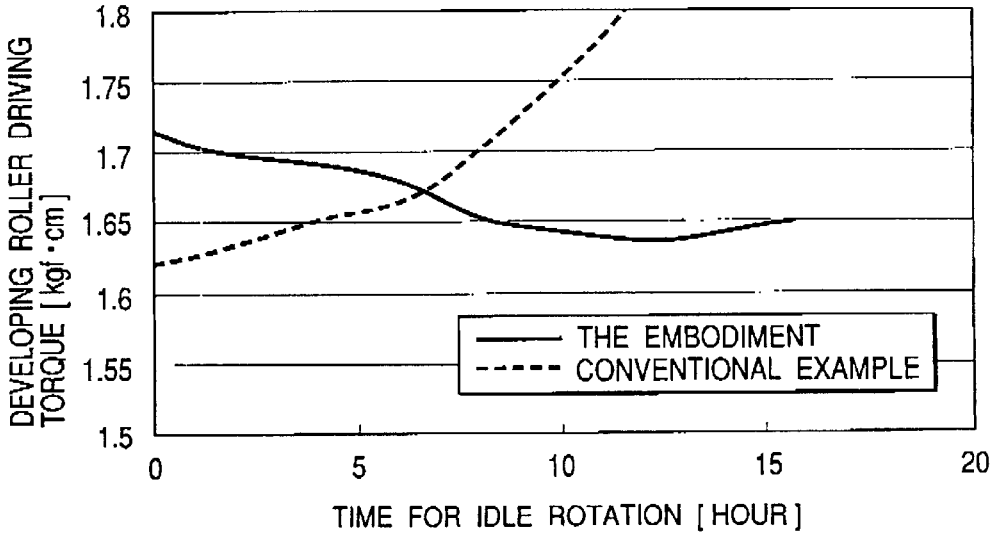
FIG. 6 shows the dependency of the torque of a developing roller on the time for rotation in the developing device.

A first embodiment of a developing device according to the present invention will hereinafter be described with reference to the drawings. FIG. 1 schematically shows the construction of an electrophotographic apparatus according to the present embodiment, FIG. 2 is an illustration of the construction of the developing device, FIGS. 3A, 3B and 3C are model views showing toner containing states and toner carrying states in three types of developing devices, FIG. 4 shows the construction of a developing device using draw-up carrying means other than a belt, FIG. 5 shows the dependency of the maximum density in the developing devices according to the present embodiment and a comparative example on the number of sheets in an endurance test, and FIG. 6 shows the dependency of the torque of developing rollers in the developing devices according to the present embodiment and the comparative example on the time for rotation.

As shown in FIG. 1, a usually drum-shaped electrophotographic photosensitive member 50 (hereinafter referred to as the photosensitive drum 50) as a latent image bearing member is uniformly charged by a primary charger 51. Next, light is applied from an exposing device 52 onto the photosensitive drum 50 correspondingly to image information input from an external device to thereby form a latent image. This electrostatic latent image on the photosensitive drum 50 is made into a visible image, i.e., a toner image, by a developer T (hereinafter referred to as the toner) having the same triboelectrification polarity as a voltage applied to the primary charger 51. The toner image is transferred to a transferring material by a transferring charger (not shown). The transferring material is stripped from the photosensitive drum 50, and subsequently is conveyed to a fixing device 55, where the toner image thereon is fixed and thereafter becomes a permanent image. Also, any toner T not transferred by the transferring charger but remaining on the photosensitive drum 50 is removed by a cleaning device 54, and the photosensitive drum 50 is used for the next image forming process.

Figure 2:
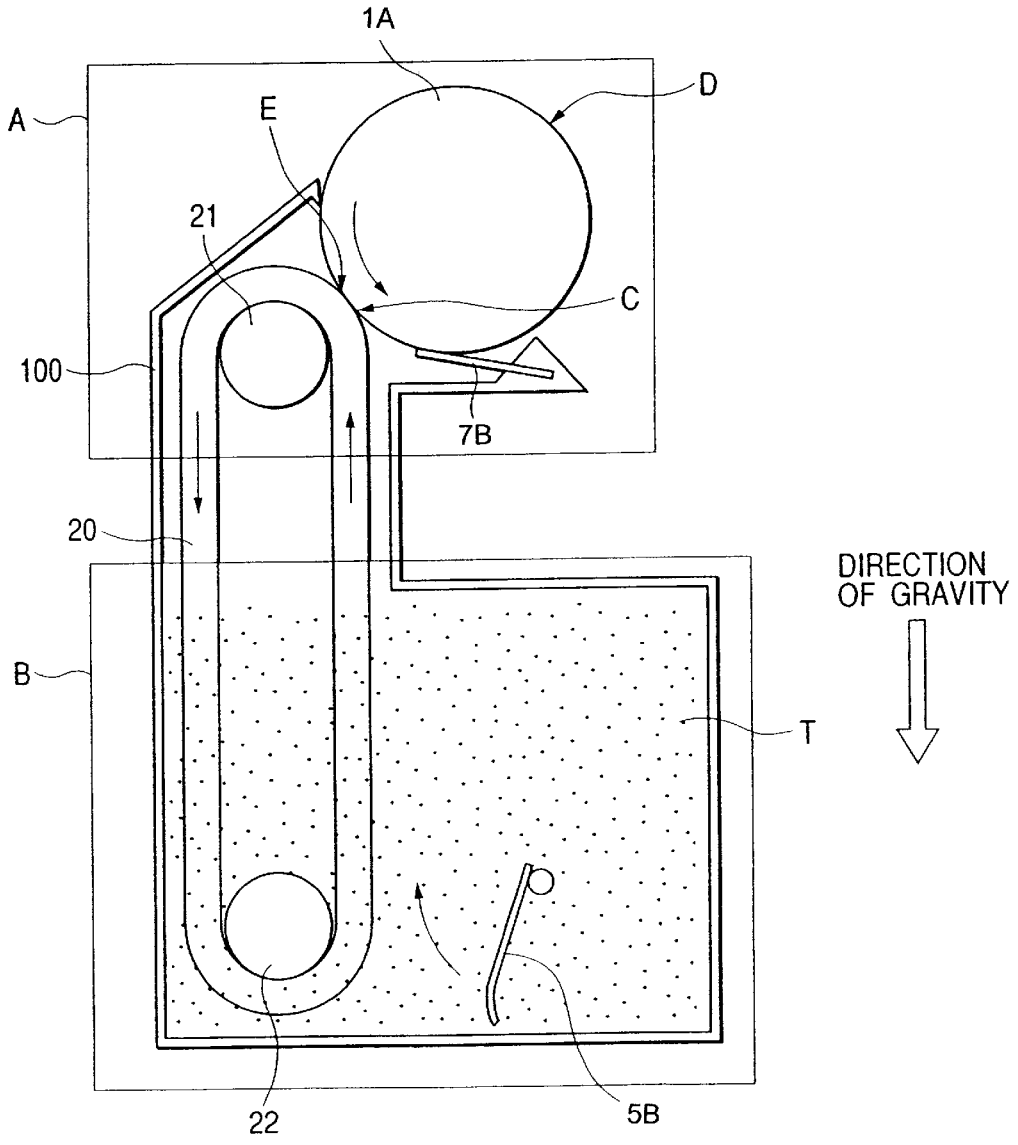
FIG. 2 is an illustration of the construction of a developing device according to the first embodiment.

A developing device 100 shown in FIG. 2 is a nonmagnetic monocomponent developing device to which the present invention is applied. The developing device 100 will hereinafter be described in detail.

In FIG. 2, a developing portion A is disposed upwardly of a toner containing portion B which is a developer containing portion with respect to the direction of gravity. A belt 20 (hereinafter referred to as the RS belt) which is toner supplying and removing means is present between the developing portion A and the toner containing portion B. The RS belt 20 is passed over two shafts, i.e., a RS belt drive roller 21 and an RS belt tension roller 22. A developing roller 1A as a developer bearing member, a toner regulating member (layer thickness regulating member) 7B and the RS belt drive roller 21 are present in the developing portion A, and the toner T as a developer, the RS belt tension roller 22 and a toner agitating member SB are present in the toner containing portion B.

Also, even if a toner container is filled with a maximum prescribed amount of toner T, when the RS belt 20 is not rotatively moved, the toner T is substantially absent near the developing roller 1A and only by the RS belt 20 being rotatively moved, the toner T may be supplied to the developing roller 1A.

Each member in the developing device 100 will first be described.

A urethane member subjected to surface treatment is used as the developing roller 1A. A phosphor bronze plate having a thickness of 0.1 mm is used as the toner regulating member 7B, and abuts against the developing roller 1A with line pressure of 30 g/cm in a counter direction with respect to the direction of rotation of the developing roller 1A. Polyurethane foam having a thickness of 5 mm and density of 0.025 g/cm$^3$ is used as the material of the RS belt 20. The urethane foam is an elastic material and has pores of average about 30 $\mu$m, and makes the carrying of the toner T and the supply and removal of the toner T to and from the developing roller 1A possible.

SUS (stainless steel) rollers of $\phi$5 mm are used as the drive roller 21 and the tension roller 22. The RS belt 20 is in contact with the developing roller 1A with contact pressure of 50 g/cm. The toner T is a nonmagnetic negatively chargeable toner manufactured by a pulverizing method or a polymerizing method.

The operation of the developing device 100 will now be described.

The developing roller 1A is rotated in the direction of arrow in FIG. 2, and the RS belt 20 is rotated in a counter direction with respect to the direction of rotation of the developing roller 1A, as shown in FIG. 2. Also, the RS belt 20 is rotatively moved at a peripheral speed of 110% relative to the rotational speed of the developing roller 1A. The sufficient supply of the toner T to the developing roller 1A and the removal of the toner T from the developing roller 1A become possible by the RS belt 20 being rotated in the counter direction with respect to the direction of rotation of the developing roller 1A, and a peripheral speed difference being taken so that the RS belt 20 may be rotatively moved at a higher speed than the developing roller 1A.

In that portion of the RS belt 20 which is present in the toner containing portion B, the agitating member 5B is rotated in the direction of an arrow in FIG. 2, whereby the toner T comes into or is absorbed to the pores present in the RS belt 20, and is carried from the toner containing portion B to the developing portion A along the movement of the RS belt 20. The carried toner T moves from the RS belt 20 to the surface of the developing roller 1A, in a supplying area C wherein the RS belt 20 and the developing roller 1A are brought into contact with each other. The toner T supplied onto the developing roller 1A has appropriate charges imparted thereto simultaneously with a thin layer being formed on the developing roller 1A by the toner regulating member 7B.

The toner T carried to a developing area D moves from the developing roller 1A to a latent image on the photosensitive drum 50 by a developing electric field by a developing bias applied between the developing roller 1A and the photosensitive drum 50 and visualizes the latent image as a toner image. As the developing bias, use is made of a voltage controlled within the range of a DC voltage of 0 V to −700 V.

Any toner T which has not been used for development in the developing area D is removed from the developing roller 1A by the frictional contact with the RS belt 20 in a removing area E. The removed toner T is carried along the movement of the RS belt 20 from the developing portion A to the toner containing portion B. Thereafter, there is formed the toner T circulation that the toner T again comes onto the RS belt 20 and is carried to the developing roller 1A.

The effect in the developing device 100 of the present embodiment will be described specifically here.

Description will first be made of an effect in a construction wherein the RS belt 20 has a carrying area upward from the toner containing portion B to the developing roller 1A and a carrying area downward from the developing roller 1A to the toner containing portion B.

FIGS. 3A, 3B and 3C show modeled views of the toner containing states and the toner carrying states in three types of developing devices differing in the arrangement of the developing portion A and the toner containing portion B from one another.

FIG. 3A shows a construction in which the toner carrying means has a carrying area downward from the toner containing portion B to the developing roller 1A and a carrying area upward from the developing roller 1A to the toner containing portion B. FIG. 3B shows a construction in which the toner carrying means has a carrying area horizontal from the toner containing portion B to the developing roller 1A and a carrying area horizontal from the developing roller 1A to the toner containing portion B. FIG. 3C shows a construction in which, as in the present embodiment, the toner carrying means has a carrying area downward from the toner containing portion B to the developing roller 1A and a carrying area upward from the developing roller 1A to the toner containing portion B.

In FIG. 3A, the carrying of the toner T from the toner containing portion B to the developing portion A is effected by gravity and therefore, the construction for the carrying of the toner T becomes very simple. However, the carrying of the toner T from the developing portion A to the toner containing portion B becomes very difficult. Therefore, the toner T carried to the developing portion A stays in the developing portion A, and the aforedescribed deterioration of the toner T becomes liable to occur. Further, the developing portion A is liable to be clogged with the toner T, and the aforedescribed packing phenomenon and blow off of the toner T from the developing portion A are liable to occur.

In FIG. 3B, the carrying of the toner T from the toner containing portion B to the developing portion A need be effected by other force than gravity, such as an agitating member. A necessary amount of toner T must always be carried to the developing portion A and thus, the blow of the toner T is always directed to the developing portion A. Accordingly, most of the toner T carried to the developing portion A stays in the developing portion A. Thereupon, as in FIG. 3A, the problems of the aforedescribed deterioration of the toner T, packing phenomenon and blowoff of the toner T are liable to arise.

In FIG. 3C, the carrying of the toner T from the toner containing portion B to the developing portion A is effected against gravity and therefore is difficult. The toner T present in the developing portion A, however, is effected by gravity and is very easily carried to the toner containing portion B. Accordingly, it is difficult for problems such as the deterioration of the toner, the toner T packing phenomenon and the blowoff of the toner T described in connection with FIGS. 3A and 3B to arise.

Consequently, by the toner carrying means adopting a construction having the carrying portion upward from the toner containing portion B to the developing roller 1A and the carrying portion downward from the developing roller 1A to the toner containing portion B, it is possible to reduce the deterioration of the toner T and prevent the toner T packing phenomenon and the blowoff of the toner T. The toner present in the developing portion A may be of a necessary amount and therefore, a construction in which the toner T is supplied to the developing roller 1A only by the RS belt 20 being rotatively moved is preferable.

Description will now be made of the effect of using the RS belt 20.

FIG. 4 shows the construction of a developing device 200 using carrying means other than a belt. Members having the same functions as those according to the first embodiment are given the same reference numerals and need not be described. In FIG. 4, the aforedescribed RS roller 2A is used as a member for supplying the toner T onto the developing roller 1A.

The developing device 200 carries the toner T from the toner containing portion B to the developing portion A by the use of the agitating member 5B , and carries the toner T from the developing portion A to the toner containing portion B by the action of gravity. In this construction, the function is performed to a certain extent, but the carrying of the toner T to the developing portion A is such that only when the agitating member 5B draws up the toner T, the toner T is supplied to the developing roller 1A and depending on the rotated position of the agitating member 5B, the carrying of the toner T to the developing portion A is not effected. That is, always stable toner supply could not be effected.

In contrast, as in the developing device 100 of the present embodiment, the toner T is drawn up by the use of the RS belt 20, whereby it has become possible to effect stable toner supply to the developing roller 1A.

Description will now be made of the effect of the developing roller 1A and the RS belt 20 being moved with a relative speed difference.

Even in a case where the developing roller 1A and the RS belt 20 are moved without any relative speed difference, the supply and removal of the toner T are possible by the portion of contact between the RS belt 20 and the developing roller 1A. However, by having the relative speed difference, the developing roller 1A has the function of wiping off the toner T on the RS belt 20. Thereby, it becomes possible to effect stabler supply and removal of the toner T.

The RS belt 20 will now be described. The developing device 100 of the present embodiment must effect draw-up carrying as previously described. When there is no unevenness on the surface of the RS belt 20, the toner T must be carried by only the adsorbing force between the toner T and the RS belt 20. However, when the surface of the RS belt 20 has unevenness, the toner T comes into concave portions, and this is very effective for the draw-up carrying of the toner T.

Also, by adopting an elastic member, tension is applied to the RS belt 20 and therefore, driving can be effected more easily than when a non-elastic member is used.

Also, a formed material or a mesh-like belt member has unevenness on the surface thereof and is an elastic member, and further is easy to manufacture. Accordingly, it is suited for use as the RS belt 20.

Comparison between the result of an experiment in the developing device 100 of the present embodiment and the result of an experiment in the developing device 160 described in the conventional art will be shown below.

FIG. 5 shows the relation between the number of sheets in an endurance test and the maximum density. This experiment is a result obtained by filling the toner container with the toner corresponding to the number of sheets in an endurance test of 8,000 sheets, outputting images at a recording rate of 4%, and having measured the density of each number of sheets in the endurance test from a density measuring device using reflected light. The solid line in FIG. 5 indicates the result of the developing device 100 of the present embodiment, and the broken line in FIG. 5 indicates the result of the conventional developing device 160. As shown in FIG. 5, in the conventional developing device 160, the maximum density suddenly lowers from the number of sheets in the endurance test of 6,000 sheets. However, it will be seen that in the developing device 100 of the present embodiment, the density is maintained up to the latter half of the endurance test. That is, the lowering of the density can be mitigated by the present invention. This means that the deterioration of the toner is reduced.

FIG. 6 shows the relation between the driving time of the developing roller 1A, the RS belt 20 and the agitating member 5B and the driving torque of the developing roller 1A. In this experiment, the developing device 100 of the present embodiment was mounted on an idle rotator and the developing roller 1A was rotated at a rotational speed of 50 rpm. Also, the rotational speeds of the RS belt 20 and the agitating member 5B at this time were 110% and 8%, respectively, relative to the developing roller 1A A developing roller driving gear is connected to an RS belt driving gear and an agitating member driving gear, and FIG. 6 shows the result of the torque when the developing roller 1A was driven having been measured by a torque measuring device. In FIG. 6, the solid line indicates the result of the developing device 100 of the present embodiment, and the broken line indicates the result of the conventional developing device 160. As shown in FIG. 6, in the conventional device 160, the torque suddenly increased from an idle rotation time of six (6) hours or so, and the blowoff of the toner from the developing portion was confirmed. Twelve (12) hours after, the developing roller 1A stopped its rotation by the packing phenomenon in which the developing portion was clogged with the toner. In the developing device 100 of the present embodiment, however, no increase in the torque occurred even if idle rotation was effected for sixteen (16) hours. That is, by the present invention, it has become possible to prevent any increase in the driving torque of the developing roller 1A. Further, such problems as the blowoff of the toner from the developing portion did not arise.

As described above, by adopting a construction in which the RS belt 20 is used as the toner carrying means and which has the toner carrying area upward from the toner containing portion B to the developing roller 1A and the toner carrying area downward from the developing roller 1A to the toner containing portion B, the toner T collected from the developing roller 1A is reliably carried to the toner containing portion B, and it does not happen that the collected toner T is continuously supplied to the developing roller 1A. Therefore, it becomes possible to reduce the deterioration of the toner T caused by frictional heat.

Also, the toner carrying means is comprised of the endless and rotatively movable RS belt 20, and the toner carrying area upward from the toner containing portion B to the developing roller 1A and the toner carrying area downward from the developing roller 1A to the toner containing portion B are formed by the RS belt 20. Thereby, the toner T collected from the developing roller 1A is reliably carried to the toner containing portion B. Therefore, a sufficient toner cooling time is provided until the toner T is again supplied to the developing roller 1A, and the surface of the toner T which has generated heat is sufficiently cooled, and the deterioration of the toner T by frictional contact can be reduced.

Also, the toner T is supplied onto the developing roller 1A only by the RS belt 20 being rotatively moved. Thus, only a necessary amount of toner T exists near the developing roller 1A, and it becomes possible to prevent the blowoff of the toner T in the developing portion A, the packing phenomenon by the toner T clogging and any increase in the driving torque of the developing roller 1A.

Also, the developing roller 1A and the RS belt 20 are moved with a relative speed difference to thereby facilitate the supply of the toner T from the RS belt 20 onto the developing roller 1A and the removal of the toner T from the developing roller 1A onto the RS belt 20.

Also, the RS belt 20 carries the toner T by the unevenness of the surface thereof to thereby make the draw-up carrying of the toner T by the RS belt 20 possible.

Also, the RS belt 20 is an elastic member to thereby make a RS belt 20 construction in which the belt is looped around a plurality of shaft possible.

Also, at least a portion of the RS belt 20 is formed of a foamed material or formed into a mesh-like shape, whereby the supply of the toner T from the RS belt 20 onto the developing roller 1A and the removal of the toner T from the developing roller 1A onto the RS belt 20 can be effected reliably.

<Second Embodiment>

Figure 7:
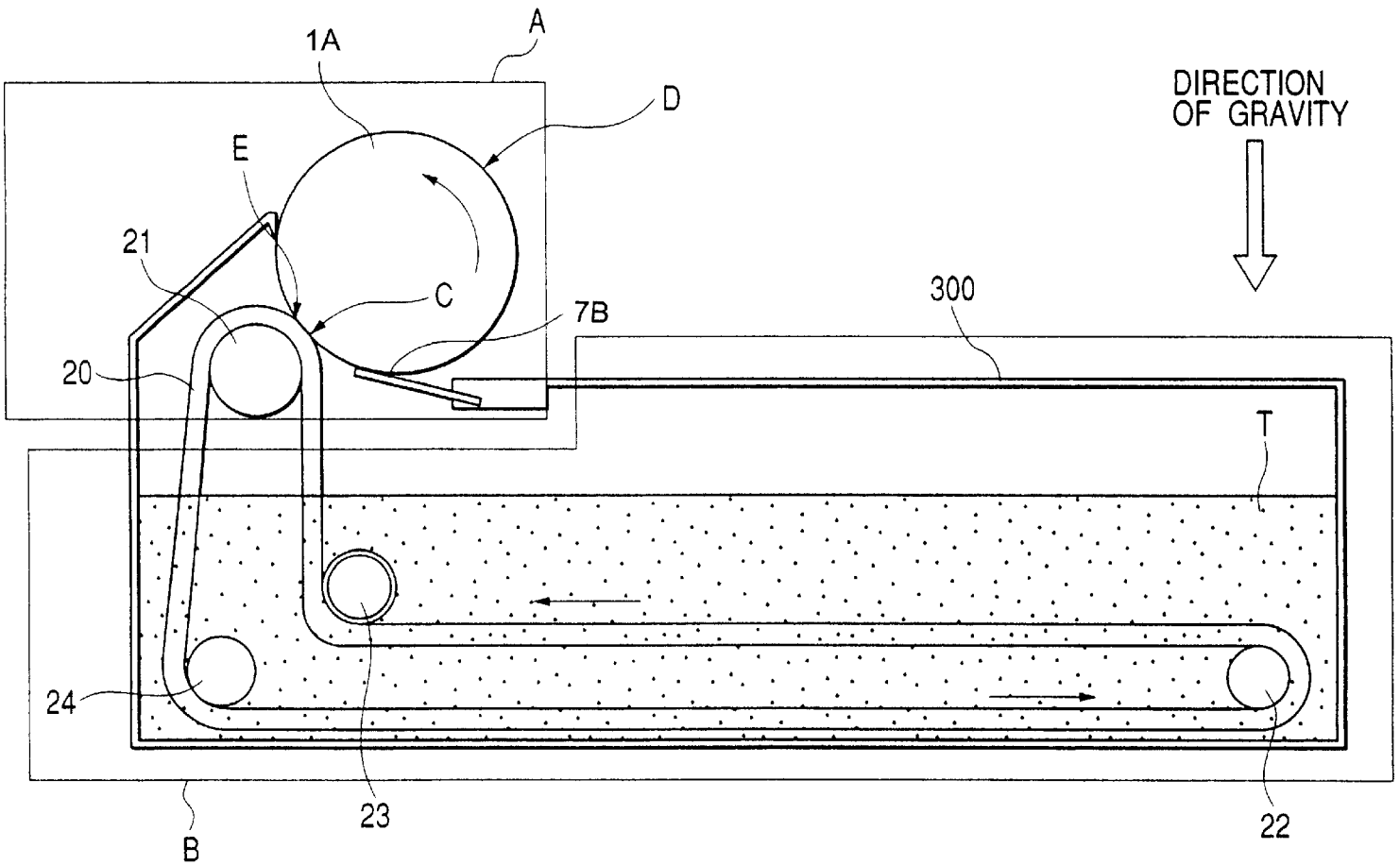
FIG. 7 is an illustration of the construction of a developing device according to a second embodiment.
Figure 8:
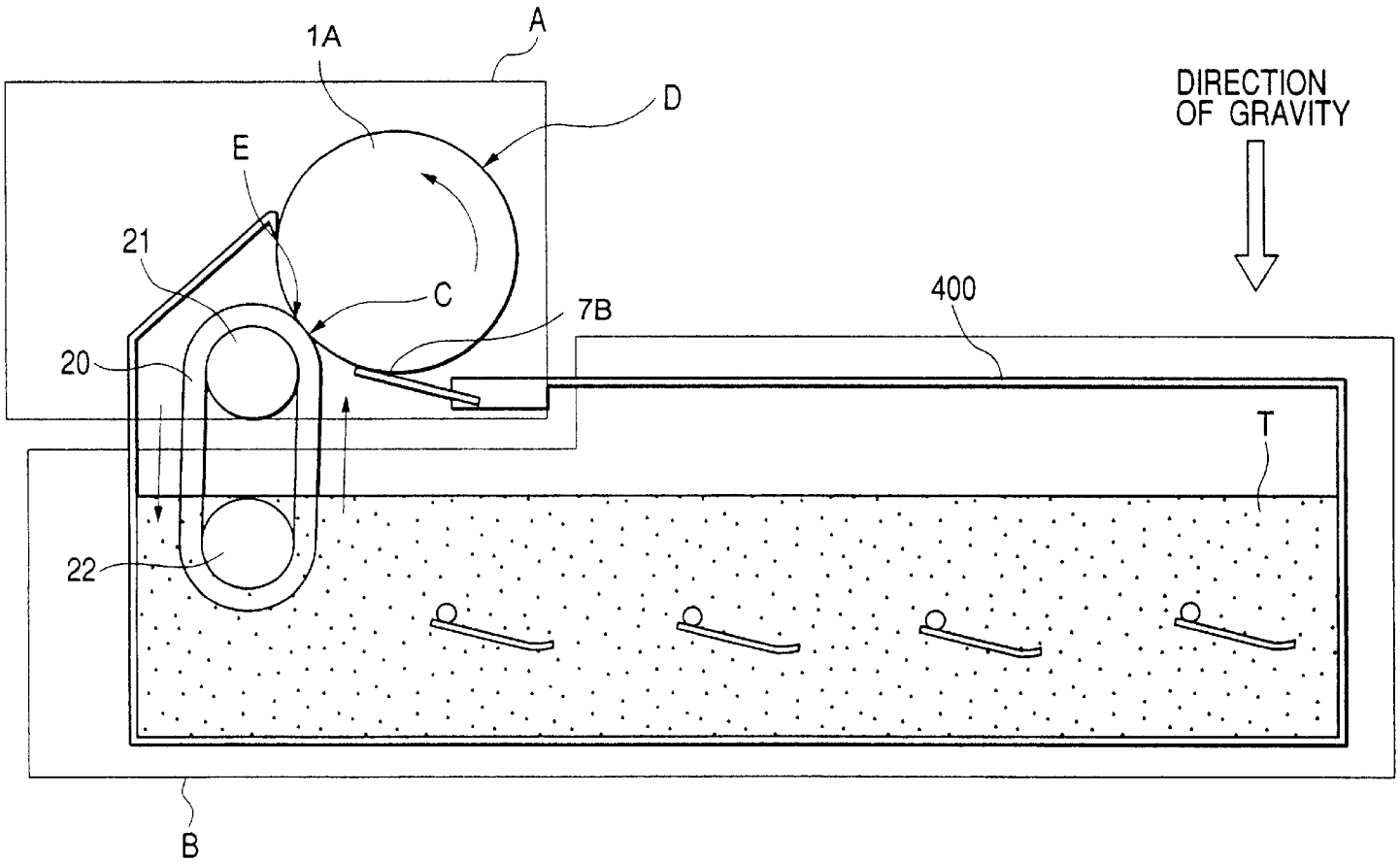
FIG. 8 is an illustration of the construction of a developing device in which an RS belt does not reach the bottom of a toner container.
Figure 9:
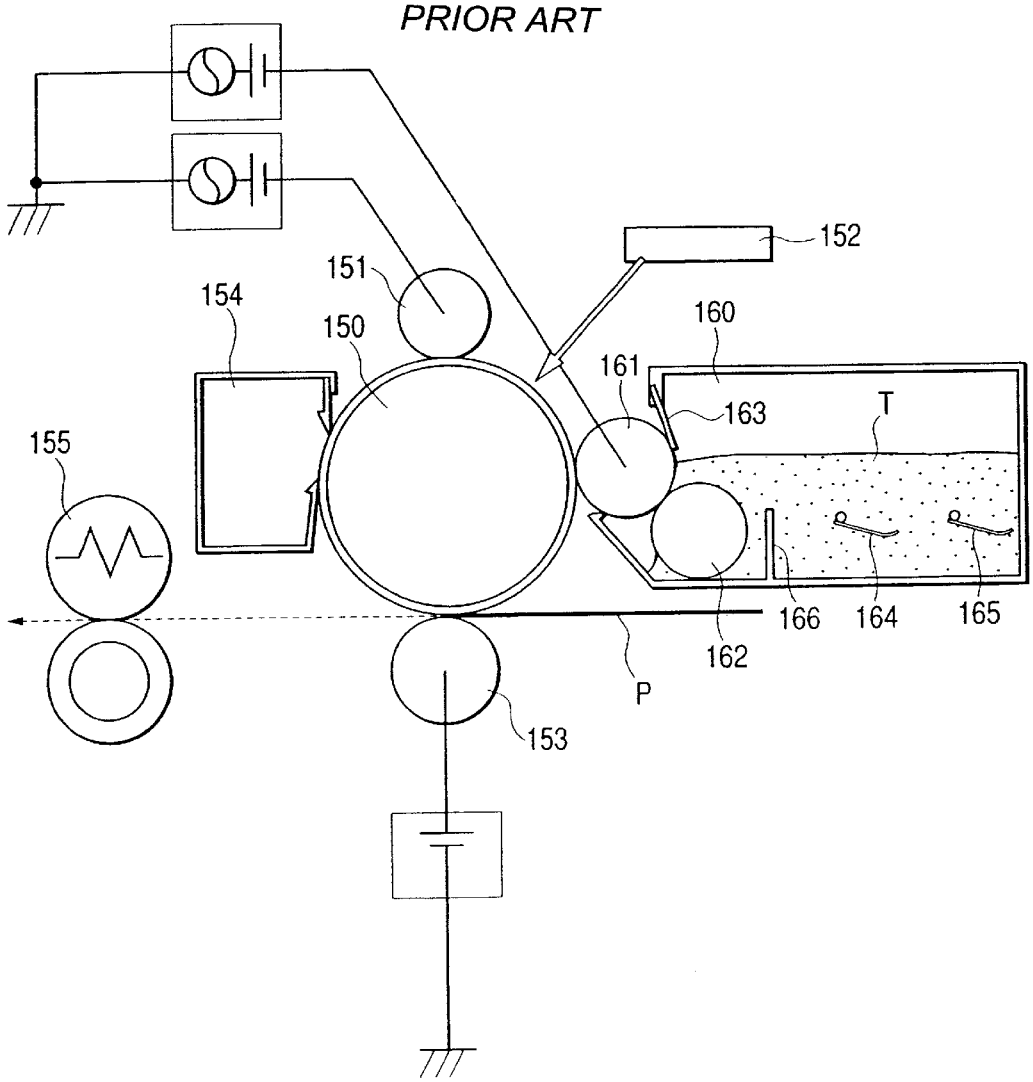
FIG. 9 PRIOR ART
FIG. 9 schematically shows the construction of a conventional electrophotographic apparatus.
Figure 10A:
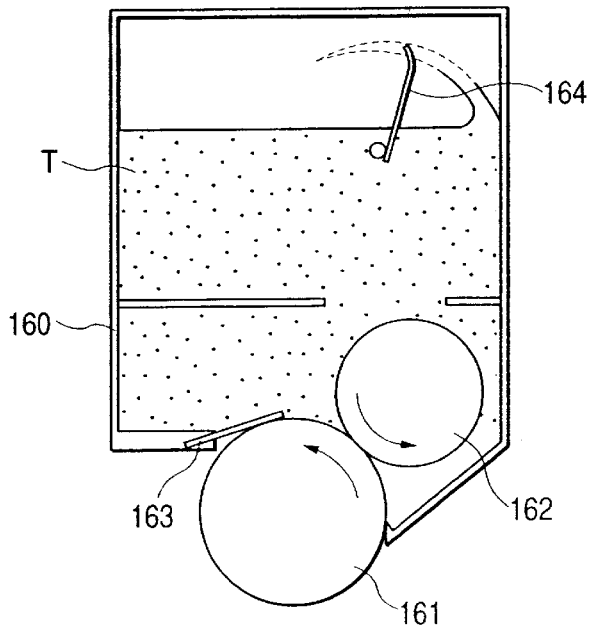
FIG. 10A PRIOR ART
FIGS. 10A and 10B are illustrations of the construction of a conventional developing device.
Figure 10A:
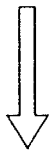
FIG. 10A PRIOR ART
Figure 10B:
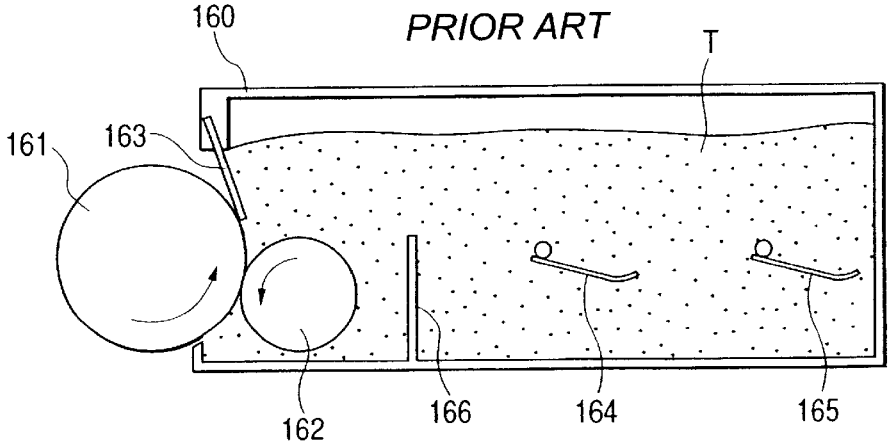
FIG. 10B PRIOR ART

A second embodiment of a developing device according to the present invention will now be described with reference to the drawings. FIG. 7 is an illustration of the construction of another developing device according to the present embodiment, and FIG. 8 is an illustration of the construction of a developing device in which the RS belt 20 does not reach the bottom of the toner container. The portions of the present embodiment which overlap those of the above-described first embodiment in description are given the same reference characters and need not be described.

The developing device 300 shown in FIG. 7, like the first embodiment, is a nonmagnetic monocomponent developing device to which the present invention is applied. The developing device 300 will hereinafter be described in detail.

In the present embodiment, the RS belt 20 between the developing portion A and the toner containing portion B is extended to the bottom of the toner container.

The toner containing portion B has therein a first rotary roller 23, a second rotary roller 24 and a tension roller 22. SUS rollers of ϕ5 mm are used as the second rotary roller 24 and the tension roller 22. As the first rotary roller 23, with the effect of supplying toner T to the RS belt 20 taken into account, use is made of a roller comprising an SUS roller of ϕ5 mm and urethane foam having a thickness of 2 mm applied to the surface of the SUS roller. The first and second rotary rollers 23, 24 are rotated in the direction of rotation of the RS belt 20. As the RS belt 20, as in the first embodiment, use is made of polyurethane foam having a thickness of 5 mm and density of 0.025 g/cm$^3$.

The operation of the developing device 300 of the present embodiment will hereinafter be described.

The developing roller 1A is rotated in the direction of the arrow in FIG. 7, and the RS belt 20, as shown in FIG. 7, is rotated in a counter direction with respect to the direction of rotation of the developing roller 1A. Also, the rotative movement speed of the RS belt 20 has a peripheral speed difference of 110% relative to the rotational speed of the developing roller 1A. The sufficient supply and removal of the toner T become possible by the RS belt 20 being rotated in the counter direction with respect to the direction of rotation of the developing roller 1A, and the RS belt 20 having the peripheral speed difference.

The toner T present in the toner T containing portion B comes into or is adsorbed to the pores in the surface of the RS belt 20 in the toner containing portion B by gravity. Then, with the movement of the RS belt 20, the toner T is carried to the developing portion A. The thus carried toner T moves from the RS belt 20 to the surface of the developing roller 1A, in a supplying area C wherein the RS belt 20 and the developing roller 1A are in contact with each other. The toner T supplied onto the developing roller 1A has appropriate charges imparted thereto simultaneously with a thin layer being formed on the developing roller 1A by a toner regulating member 7B.

The toner T carried to a developing area D adheres from the developing roller 1A to the latent image portion on the photosensitive drum 50 by a developing electric field by a developing bias applied between the developing roller 1A and the photosensitive drum 50, and visualizes the latent image as a toner image. As the developing bias, use is made of a voltage controlled within the range of a DC voltage of 0 V to −700 V.

Any toner T which has not been used for development in the developing area D is removed from the developing roller 1A in a removing area E by the frictional contact with the RS belt 20. The thus removed toner T is carried along the movement of the RS belt 20 to the bottom of the developing container which is the toner containing portion B. Thereafter, the toner T circulates, such that the toner T again comes onto the RS belt 20 and is carried to the developing roller 1A.

Again in the developing device 300 of the present embodiment, an experiment similar to that in the first embodiment was carried out. As a result, as in the first embodiment, the lowering of the density and an increase in the driving torque of the developing roller 1A did not occur. The showing thereof is similar to that of the first embodiment and therefore is omitted.

Here, the effect of the developing device 300 of the present embodiment will be described by comparing it with a developing device 400 in which the RS belt 20 does not reach the bottom of the toner container.

FIG. 8 shows the developing device 400 in which the RS belt 20 does not reach the bottom of the toner container. The developing device 400 of FIG. 8 is comprised of members that are functionally similar to those of the developing devices of the first embodiment and the second embodiment and, therefore, those members are given the same reference numerals and need not be described.

In the developing device 400 of FIG. 8, when the toner T is sufficiently present in the toner containing portion B, and specifically when the toner T reaches the RS belt 20 of a tension roller portion, the toner T functions sufficiently. However, when the toner T becomes little, the toner T must be carried to the RS belt 20 by an agitating member in FIG. 8. If the draw-up carrying of the toner T by such an agitating member are effected, the possibility of becoming incapable of supplying necessary sufficient toner T to the developing roller 1A heightens.

So, as in the developing device 300 of the present embodiment, the RS belt 20 is extended to the bottom surface of the toner container which is the toner containing portion B, whereby even if the toner T in the toner containing portion B becomes little, it is possible to supply a necessary sufficient amount of toner T onto the developing roller 1A. Also, the degree of freedom of the shape of the toner container increases and it becomes possible to carry the toner T to the developing portion A without the use of an agitating member, and it becomes possible to achieve the simplification of the agitating member.

Also, as in the first embodiment, the developing portion A is disposed upwardly of the toner containing portion B, and therebetween there is formed the RS belt 20 which makes the carrying, supply and removal of the toner T to and from the developing roller 1A possible, whereby it becomes possible to carry a suitable amount of toner T to the developing roller 1A, and the toner T once brought into frictional contact and having frictional heat can be reliably carried to the toner containing portion B. Therefore, the surface of the toner T which has generated heat is cooled by getting a sufficient radiating time, and it has become possible to reduce the deterioration of the toner T due to frictional contact.

Also, since the developing portion A is disposed upwardly of the toner containing portion B, the developing portion A is not clogged with the toner T, and it is possible to prevent the blowoff of the toner T from the developing portion A, the packing phenomenon and any increase in the torque of the developing roller 1A.

<Third Embodiment>

Figure 11:
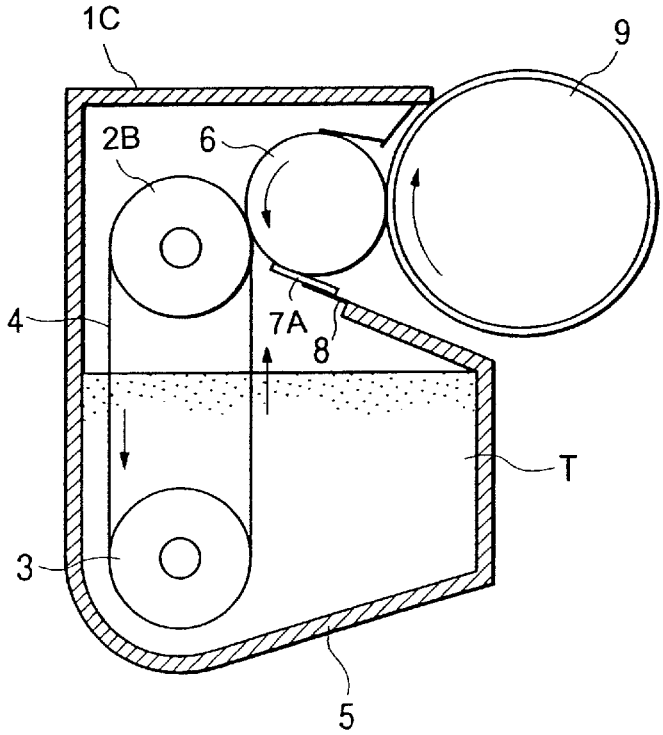
FIG. 11 is a schematic cross-sectional view of a developing device according to a third embodiment.
Figure 12:
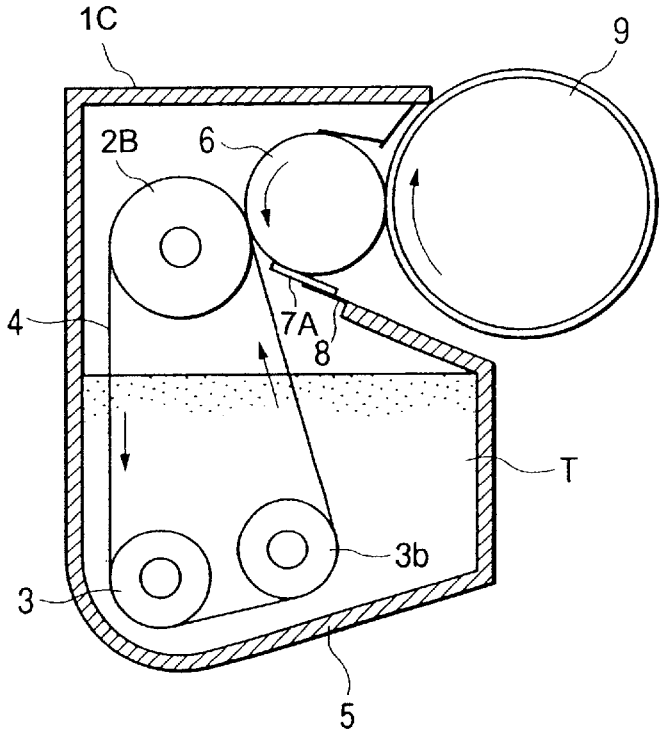
FIG. 12 is a schematic cross-sectional view of a developing device in which a toner supplying belt is looped on three shafts.
Figure 13:
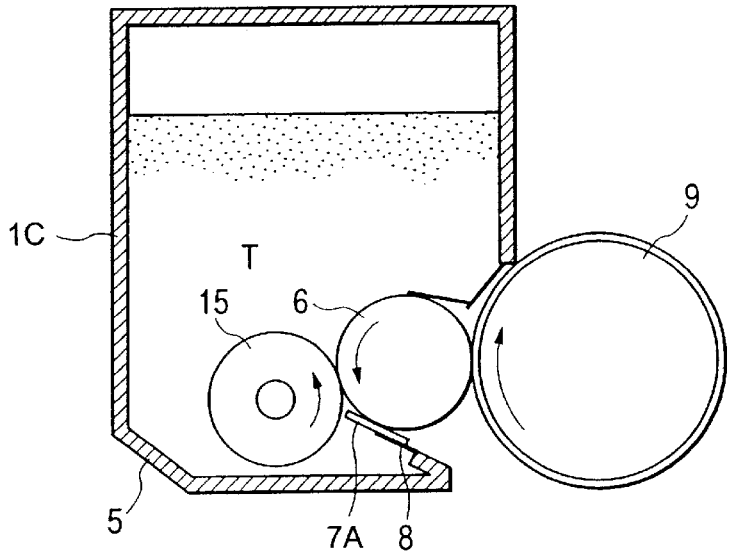
FIG. 13 PRIOR ART
FIG. 13 is a schematic cross-sectional view of a developing device according to Comparative Example 1.
Figure 14:
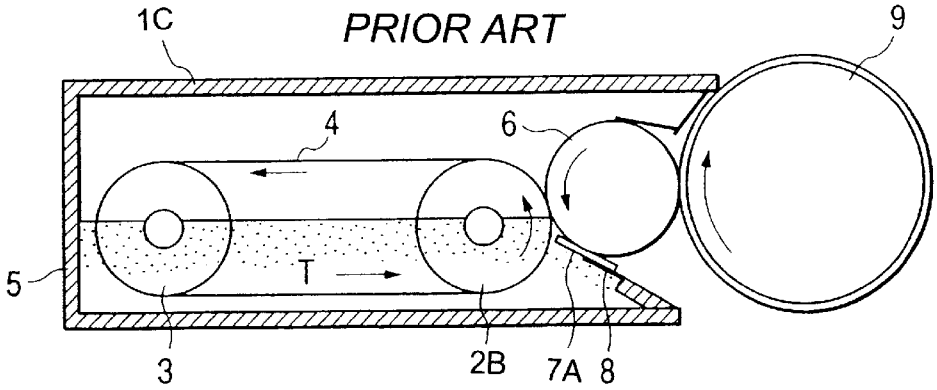
FIG. 14 PRIOR ART
FIG. 14 is a schematic cross-sectional view of a developing device according to Comparative Example 2.
Figure 15:
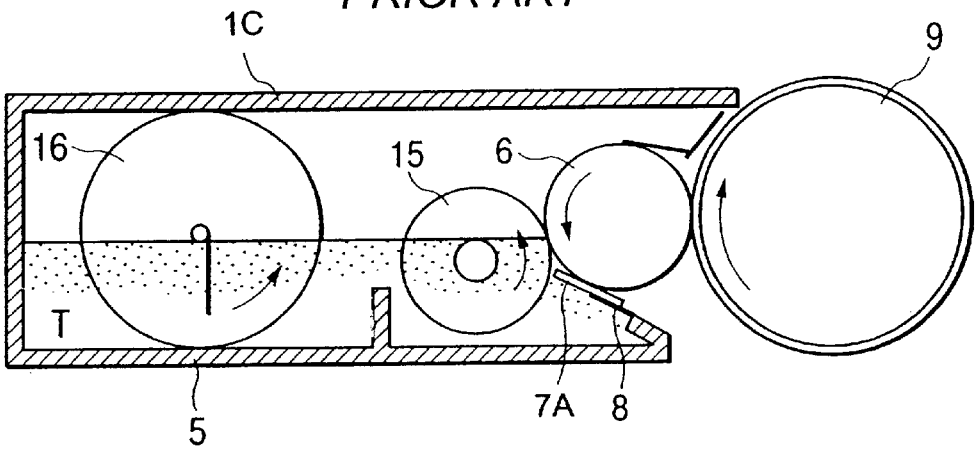
FIG. 15 PRIOR ART
FIG. 15 is a schematic cross-sectional view of a developing device according to Comparative Example 3.
Figure 16:
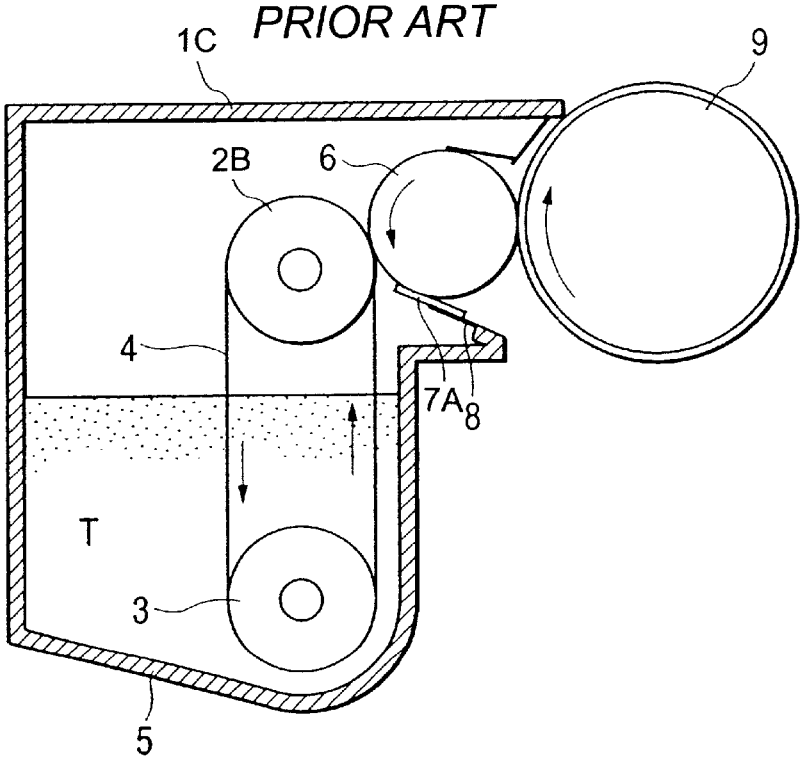
FIG. 16 PRIOR ART
FIG. 16 is a schematic cross-sectional view of a developing device according to Comparative Example 4.
Figure 17:
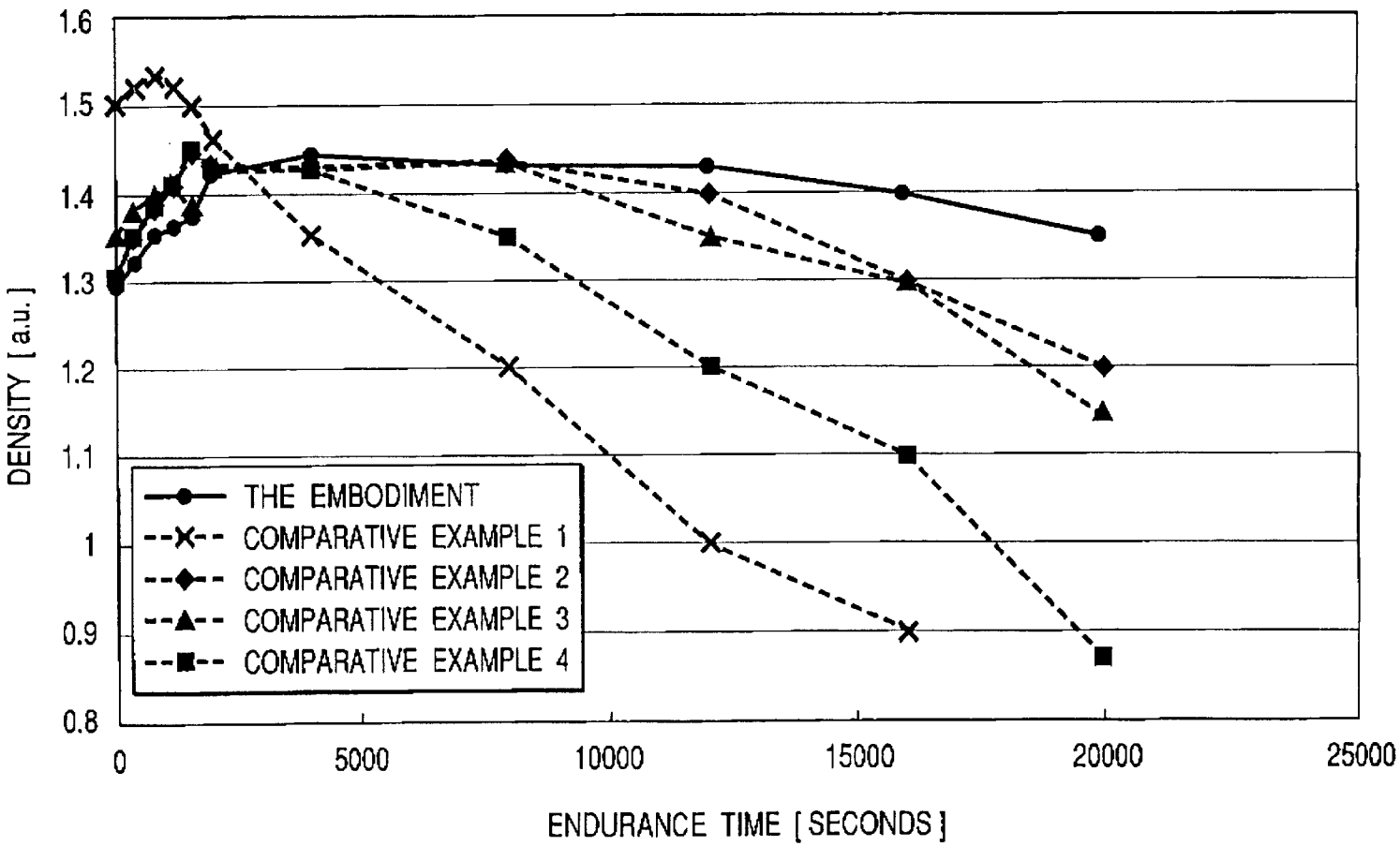
FIG. 17 shows the result of a comparing experiment for the enduring performance of the developing device and that of the conventional developing devices.

A third embodiment of a developing device according to the present invention will now be described with reference to the drawings. FIG. 11 is a schematic cross-sectional view of a developing device according to the present embodiment, FIG. 12 is a schematic cross-sectional view of a developing device when a toner supplying belt is looped on three shafts, FIG. 13 is a schematic cross-sectional view of a developing device according to comparative Example 1, FIG. 14 is a schematic cross-sectional view of a developing device according to Comparative Example 2, FIG. 15 is a schematic cross-sectional view of a developing device according to Comparative Example 3, FIG. 16 is a schematic cross-sectional view of a developing device according to Comparative Example 4, and FIG. 17 shows the result of a comparing experiment for the enduring performance of the developing device according to the present embodiment and that of the developing devices according to the comparative examples.

(Structure)

In FIG. 11, the letter T designates the aforedescribed nonmagnetic negatively chargeable toner manufactured by the pulverizing method, and the developing device 1C is comprised of a developer containing portion 5 (developing container) a photo-sensitive drum 9 which is an image bearing member, developer carrying means (2B, 3, 4) and an elastic regulating blade 7A which is a developer regulating member.

The developer carrying means is constituted by a first belt looping roller 2B which is a first looping roller installed in opposed relationship with a developing sleeve 6, a second belt looping roller 3 which is a second looping roller, and a toner supplying belt 4 which is an endless carrying member looped on the first belt looping roller 2B and the second belt looping roller 3, and the developer carrying means has an area for upwardly carrying a developer, and the developer containing portion 5 is enlargedly provided on the toner supplying side of the toner supplying belt 4.

The first belt looping roller 2B and the second belt looping roller 3 are rotatively driven by motors, not shown, and are rotated in the direction of the arrow in FIG. 11 at a peripheral speed of 120 mm/sec., to thereby carry the toner T present in a great deal on the toner supplying belt 4 toward the developing sleeve 6 which is a developer bearing member and supply a sufficient amount of toner T to the developing sleeve 6.

In the present embodiment, as the toner supplying belt 4, use is made of polyurethane foam having a thickness of 3 mm, a width of 230 mm and an outer peripheral length of 124 mm. While single-layer foamed polyurethane foam is used as the toner supplying belt 4, there is no problem even if the toner supplying belt 4 is formed by a plurality of layers. If for example, the surface of contact with the looping shaft which is the inner side of the toner supplying belt 4 is formed of non-foamed silicon rubber, and the developing sleeve 6 side thereof is formed of foamed polyurethane foam, durability can be further improved.

Also, it is preferable that the size of pores provided in the toner supplying belt 4 be constant within the latent image forming width range of the photosensitive drum 9, but it need not be constant along the direction of the thickness of the toner supplying belt 4.

As each of the first belt looping roller 2B and the second belt looping roller 3, use is made of a roller of $\phi$12 mm in its outer diameter comprising an aluminum mandrel having a diameter of 8 mm and an EPDM sponge layer having a thickness of 2 mm formed on the mandrel.

While in the present embodiment, the toner supplying belt 4 is looped on two shafts, there is no problem even if the toner supplying belt 4 is looped on three shafts by the additional use of a third belt looping roller 3*b*, as shown in FIG. 12, and in this case, there is no change in the effect of the present invention.

The toner supplying belt 4 is in contact with the developing sleeve 6 with contact pressure of 40 g/cm, and triboelectrifies the toner T carried on the toner supplying belt 4 with the developing sleeve 6, and applies the toner T to the developing sleeve 6 by the mirror image force of the toner T itself and at the same time, removes the toner T on the developing sleeve 6 which has not been used for development by frictionally contacting with the toner T. That is, the toner supplying belt 4 has not only the function of drawing up the toner T, but also the function of supplying the toner T to the developing sleeve 6 and the function of removing the toner T from the developing sleeve 6.

The developing sleeve 6 is formed of aluminum having a diameter of 12 mm and having electrical conductivity, and is disposed so as to contact with the photosensitive drum 9 opposed thereto, and is rotated at a peripheral speed of 120 mm/sec. in a counter direction (the direction of the arrow in FIG. 11) with respect to the toner supplying belt 4.

Also, the elastic regulating blade 7A formed of silicone resin as a toner amount regulating member (toner layer thickness regulating member) abuts against the developing sleeve 6. The regulating blade 7A is heat-welded to a phosphor bronze plate 8 having a thickness of 150 $\mu$m which is a supporting member, and abuts with line pressure of 30 g/cm in a counter direction with respect to the direction of rotation of the developing sleeve 6, and regulates the toner T on the developing sleeve 6 to thereby form a thin toner T layer, and regulates the amount of toner T carried to a developing area (the portion of contact with the photosensitive drum 9) and at the same time, impacts appropriate charges (−20 $\mu$C/g) to the toner T.

The toner T carried to the developing area moves from the developing sleeve 6 to the latent image on the photosensitive drum 9 by a developing electric field by a developing bias applied between the developing sleeve 6 and the photosensitive drum 9, and visualizes the latent image as a toner image. As the developing bias, use is made of an AC voltage of 2600 Hz and 1800 Vpp superimposed on a DC voltage of −500 V.

Any toner T not used for development in a portion opposed to the photosensitive drum 9 is removed from the developing sleeve 6 by the frictional contact thereof with the toner supplying belt 4, is carried along the toner supplying belt 4 and is returned to the developer containing portion 5.

Also, the bottom portion of the developer containing portion 5 is inclined by 50° from a vertical direction so that the toner T may be carried to the toner supplying belt 4 by the gravity thereof.

Heretofore, to carry the toner T from the developer containing portion to the developing portion, it has been necessary to carry the toner T by the utilization of gravity, or horizontally dispose the toner containing portion and the developer containing portion, and drive an agitating member in the developing container.

(Comparative Example 1)

For example, as a method of carrying the toner by the utilization of gravity, mention may be made of a construction as shown in FIG. 13 (Comparative Example 1). In FIG. 13, members functionally similar to those in the third embodiment are given the same reference numerals. The reference numeral 15 designates a toner supplying roller which is a member for performing the supply and removal of the toner T to and from the developing sleeve 6.

However, in the construction of FIG. 13 shown as Comparative Example 1, the carrying of the toner T by the gravity of the toner T is simple, but the handling of the toner T is difficult and above all, for a nonmagnetic toner, the blowoff and scattering of the toner T from the opening portion of the developing container by the pressure of the toner T pose a problem.

(Comparative Example 2 and 3)

On the other hand, as a construction in which the developer containing portion 5 and the developing portion are disposed in a horizontal direction, mention may be made of a construction as shown in FIG. 14 (Comparative Example 2), or a construction as shown in FIG. 15 (Comparative Example 3).

In FIG. 15 showing Comparative Example 3, the reference numeral 16 designates an agitating member which performs the function of carrying the toner T toward the developing sleeve 6. Also, in Comparative Example 2, the toner supplying belt 4 is looped in a horizontal direction.

In Comparative Example 3 shown in FIG. 15 there arises the following problem. The toner supplying roller 15 is rotated in the direction of an arrow to thereby supply the toner T to the developing sleeve 6, but the surplus of the toner T supplied from the toner supplying roller 15 to the developing sleeve 6 collects below the elastic regulating blade 7A and comes to hamper the supply of fresh toner T. That is, there is no outlet for the surplus toner T and a circulation route is not formed and therefore, the surplus toner T continues to collect below the elastic regulating blade 7A and only the toner T deteriorated by frictional contact collects around the developing sleeve 6 and therefore, when rotation is effected for a long time, it becomes difficult to effect development appropriately.

Again in the construction shown in Comparative Example 2, the toner T likewise continues to collect below the elastic regulating blade 7A and therefore, this construction is inferior in developing endurance performance.

(Comparative Example 4)

Also, a construction as shown in FIG. 16 (Comparative Example 4) wherein the developer containing portion 5 is enlargedly disposed on a nontoner supplying surface side with respect to the toner supplying belt 4 of the developing device 1C of the present embodiment would also occur to mind as a developing device 1C, but as in what has been described above, the deteriorated toner T continues to collect below the elastic regulating blade 7A and therefore, this construction becomes inferior in enduring performance.

(Operation)

In contrast, the present embodiment is an excellent developing device which solves the above-noted problem and maintains stable enduring performance. The operation of the developing device according to the present embodiment will hereinafter be described in detail.

In the developing device 1C according to the present invention, as shown in FIG. 11, the toner supplying belt 4 is provided in the developing device 1C so that the toner T in the developer containing portion 5 may be supplied to the developing sleeve 6 by the toner supplying belt 4.

This toner supplying belt 4 is a belt-shaped member made of polyurethane foam looped on the first belt looping roller 2B connected to a stepping motor, not shown, and the second belt looping roller 3, and the toner supplying belt 4 is rotatively moved in the direction of the arrow in FIG. 11 by the rotation of the first belt looping roller 2B.

When this developing device 1C becomes operative, the toner supplying belt 4 in the developing device 1C is rotatively moved in the direction of the arrow in FIG. 11. At this time, the toner supplying belt 4 sufficiently holds in the pores in the surface thereof the toner T contained in the developer containing portion 5 installed so as to be adjacent to the surface of the toner supplying belt 4 moved toward the developing sleeve 6.

The toner T held in the toner supplying belt 4 moves in the direction of the arrow and is supplied to the portion of pressure contact with the developing sleeve 6, and coats the surface of the developing sleeve 6. At this time, any toner T excessively supplied from the toner supplying belt 4 falls from gravity and returns to the developer containing portion 5. Also, the surplus toner T on the surface of the developing sleeve 6 removed by the elastic regulating blade 7A likewise returns to the developer containing portion 5. As described above, the surplus of the toner T supplied to the developing sleeve 6 can be quickly collected into the enlarged developer containing portion 5 without staying.

On the other hand, the toner T coating the developing sleeve 6 and not used for developing at the position opposed to the photosensitive drum 9 is again removed at the inlet to the portion of pressure contact with the toner supplying belt 4, is carried along the direction of movement of the toner supplying belt 4, passes below the second belt looping roller 3 and returns to the developer containing portion 5. Thus, an endless route is secured even for the toner T removed from the surface of the developing sleeve 6 and therefore, it never happens that the toner T coheres in a narrow shape and is frictionally contacted and is deteriorated thereby.

(Experiment)

Comparison about the stability of the developer supplying performance and the enduring performance was made between the developing device of the present embodiment having the above-described construction and the conventional developing devices.

In the conventional developing devices, there was no problem under normal environment of the order of 20° C., but particularly under high-temperature and high-humidity environment, there appeared the phenomenon that the charged amount of the toner gradually lowered and the developing performance lowered. So, as particularly severe conditions, the present comparison experiment was made under environment of room temperature 35° C. and humidity 90%.

Comparison was made by installing photosensitive drums, charging means and exposing means in the respective developing devices to thereby visualize a latent image on the photosensitive drums, and measuring the density of the developed images on the photosensitive drums.

The photosensitive drums are charged to −650 V by roller charging, and are exposed by a laser having a quantity of light of 3.0 $mJ/m^2$ to thereby form latent images on the photosensitive drums. Also, a developing bias applied between the developing sleeve and the photosensitive drum is AC of a frequency 2600 Hz and a voltage 1800 V superimposed on a low voltage DC of −500 V. The toners on the developed photosensitive drums are adapted to be removed by cleaning devices abutting against the photosensitive drums.

Endurance was tested by continuing the charging, latent image forming, developing and cleaning processes as described above, and changes in the density on the photosensitive drums in the developed portions thereof were measured.

FIG. 17 shows the state of changes in the density of the toner images on the surfaces of the photosensitive drums for the endurance time. It shows that the higher is the numerical value of the density, the greater is the amount of toner, and it is more preferable that the density be stable.

A density change of a change width of the order of 0.15 by rising appearing at the initial stage of the endurance is of a degree in which the change in density is not seen in practical images and therefore, poses no problem and is within an allowable range.

As shown in FIG. 17, it will be seen that in the developing device of the present embodiment, in contrast with the comparative examples, stable density is kept even if the number of printed sheets is increased. This is because in the developing device of the present embodiment, the supply of the toner to the developing sleeve is sufficiently effected and the circulation route of the toner is secured and, therefore, it is difficult for stress to be given to the toner and this deters the deterioration of the toner. That is, it has been found that in the present embodiment, stable image density is maintained even for long-term use.

With the construction as described above, even when the developing portion having the developing sleeve overlies the developer containing portion, the sufficient supply of the toner to the developing sleeve becomes possible without the toner being deteriorated, and it has become possible to make the developing device excellent in enduring performance.

Further, by utilizing the belt, the degree of freedom of the disposition, size and shape of the developer containing portion is increased and therefore, it has also become possible to achieve the downsizing of the entire developing device.

<Fourth Embodiment>

Figure 18:
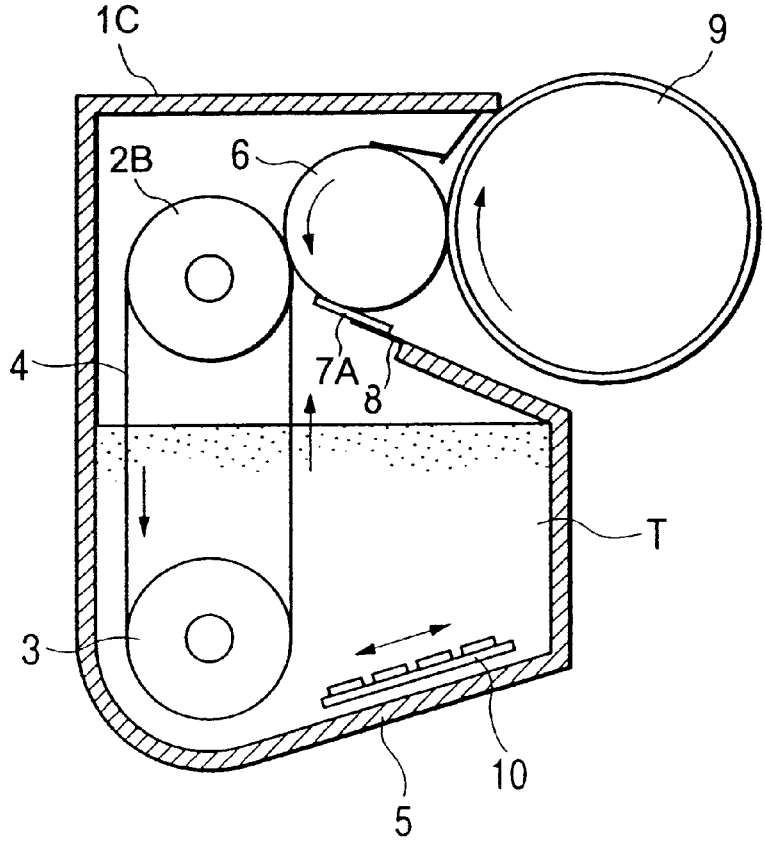
FIG. 18 is a schematic cross-sectional view of a developing device according to a fourth embodiment.
Figure 19:
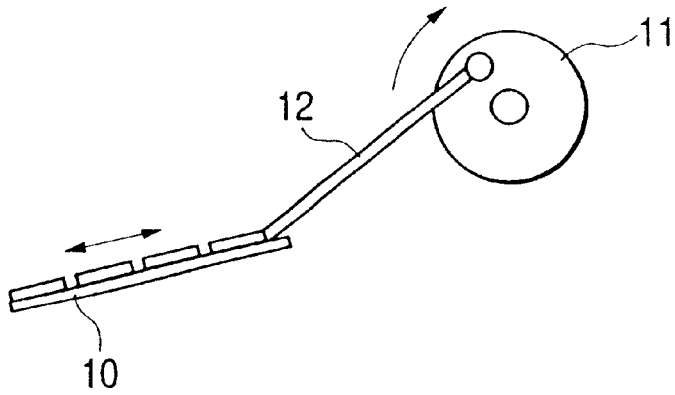
FIG. 19 is a typical view showing a method of drawing an agitating plate in the developing device.

A fourth embodiment of a developing device according to the present invention will now be described with reference to the drawings. FIG. 18 is a schematic cross-sectional view of the developing device 1C according to the present embodiment, and FIG. 19 is a typical view showing a method of driving an agitating plate in the developing device. The portions of the present embodiment which overlap those of the above-described third embodiment in description are given the same reference characters and need not be described.

As shown in FIG. 18, in the present embodiment, a toner agitating device, including an agitating plate 10, is provided on the bottom of the developer container. The toner agitating device has a drainboard-shaped agitating plate 10 as agitating means for agitating the developer disposed on the bottom of the inclined developer containing portion 5. The toner agitating device operates the agitating plate 10 back and forth to thereby assist the toner T in falling toward the toner supplying belt 4 from gravity.

Means for operating the agitating plate 10 adopts a construction as shown, for example, in FIG. 19. In FIG. 19, the reference numeral 10 designates the agitating plate, the reference numeral 11 denotes a drive transmitting roller, and the reference numeral 12 designates a connecting arm. The drive transmitting roller 11 is rotated by the same stepping motor as that for the first belt looping roller 2B, and is connected to a location at which the connecting arm 12 deviates from the center of rotation of the drive transmitting roller 11.

Thus, it becomes possible for the agitating plate 10 connected to the connecting arm 12 to be operated back and forth with the rotation of the drive transmitting roller 11 to thereby make even the toner T staying on the bottom of the developer containing portion 5 effectively usable for development.

By the agitating plate 10 being installed in the developer containing portion 5 as in the present embodiment, the supply of the toner T to the toner supplying belt 4 is done without resort to only the gravity of the toner T and therefore, even when as in the above-described third embodiment, the developing portion overlies the developer containing portion 5, the sufficient supply of the toner T to the developing sleeve 6 becomes possible without the toner T being deteriorated, and enduring performance can be improved and also, supplying performance can be further improved.

<Fifth Embodiment>

Figure 20:
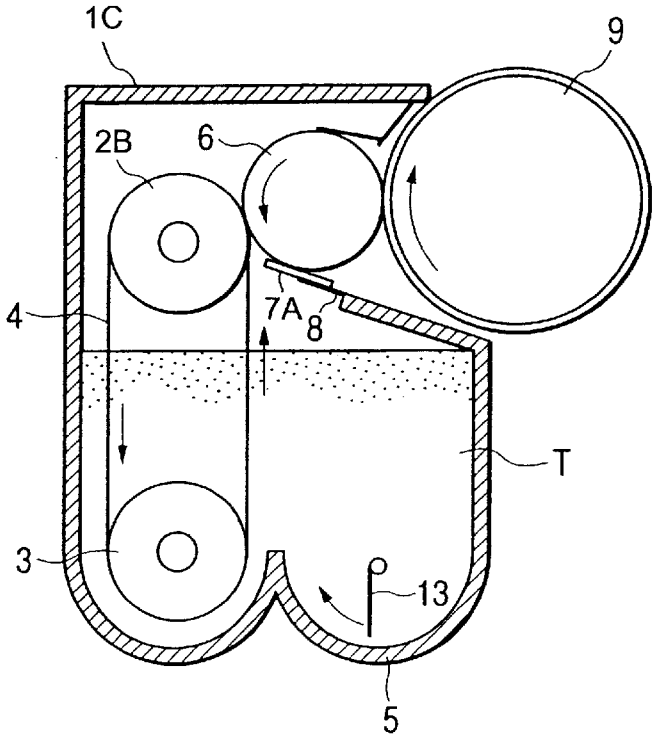
FIG. 20 is a schematic cross-sectional view of a developing device according to a fifth embodiment.

A fifth embodiment of a developing device according to the present invention will now be described with reference to the drawings. FIG. 20 is a schematic cross-sectional view of the developing device 1C according to the present embodiment. The portions of the present embodiment which overlap those of the third embodiment in description are given the same reference characters and need not be described.

As shown in FIG. 20, the present embodiment is characterized in that instead of the agitating plate 10 in the above-described fourth embodiment, a paddle 13 which is a rotary member is installed as agitating means, and the paddle 13 is rotated in a direction opposite,to the direction of rotation of the toner supplying belt 4.

As shown in FIG. 20, the paddle 13 is installed on the bottom of the developer containing portion 5, which is made into an arcuate shape in accordance with the rotational shape of the paddle 13. The paddle 13 is rotated in the direction of the arrow in FIG. 20 by the same stepping motor as that for the first belt looping roller 2B, and is adapted to supply the toner T collecting on the bottom of the developer containing portion 5 to the toner supplying belt 4.

The direction of rotation of the paddle 13 can be made the same as or opposite to the direction of rotation of the first belt looping roller 2B, but if the direction of rotation of the paddle 13 is made the same as the direction of rotation of the first belt looping roller 2B, when the toner T becomes small in amount, the toner T raised by the paddle 13 is scraped up along the right wall surface of the developer containing portion 5 as viewed in FIG. 20, but immediately falls into the developer containing portion 5 and the toner T not supplied to the toner supplying belt 4 becomes residual.

On the other hand, the direction of rotation of the paddle 13 is made opposite to the direction of rotation of the first belt looping roller 2B, whereby the toner T raised by the paddle 13 is scraped up along the left wall surface of the developer containing portion 5, and it becomes possible to send the toner T to the toner supplying belt 4 located leftwardly thereof. Therefore, it is preferable that, as indicated by the arrow in FIG. 20, the paddle 13 be rotated in the direction opposite to the direction of rotation of the first belt looping roller 2B.

As described above, without resort to the gravity of the toner T, use is made of the paddle 13 for positively effecting the supply of the toner T and the direction of rotation of the paddle 13 is set to the most efficient direction, whereby it has become possible to further improve the toner supplying capability, as compared with the developing device of the above-described fourth embodiment.

Further, the bottom of the developer containing portion 5 need not be inclined and therefore, as compared with the developing device of the above-described fourth embodiment, it also becomes easy to make the capacity of the developer containing portion 5 larger.

While here, description has been made of a case where a paddle 13 is installed in the developing device 1C, it is also of course possible to install a plurality of paddles 13, and the shape of the developer containing portion 5 can be made to match the same.

<Sixth Embodiment>

Figure 21:
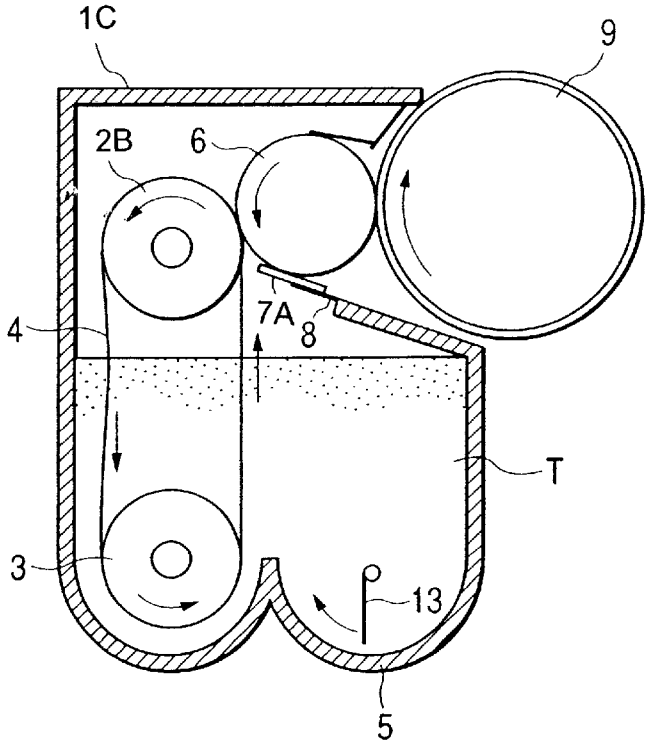
FIG. 21 is a schematic cross-sectional view of a developing device according to a sixth embodiment.
Figure 22:
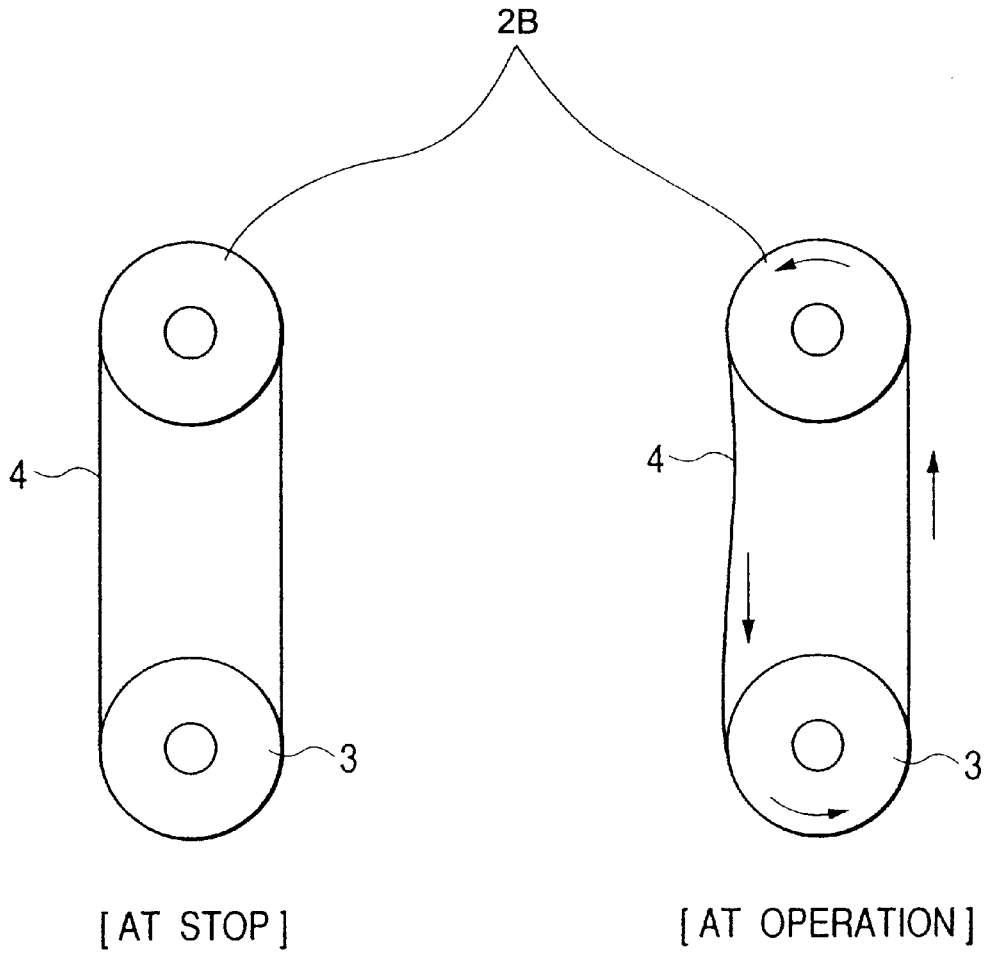
FIG. 22 shows the looped states of a toner supplying belt at stop and at operation in the developing device.
Figure 23:
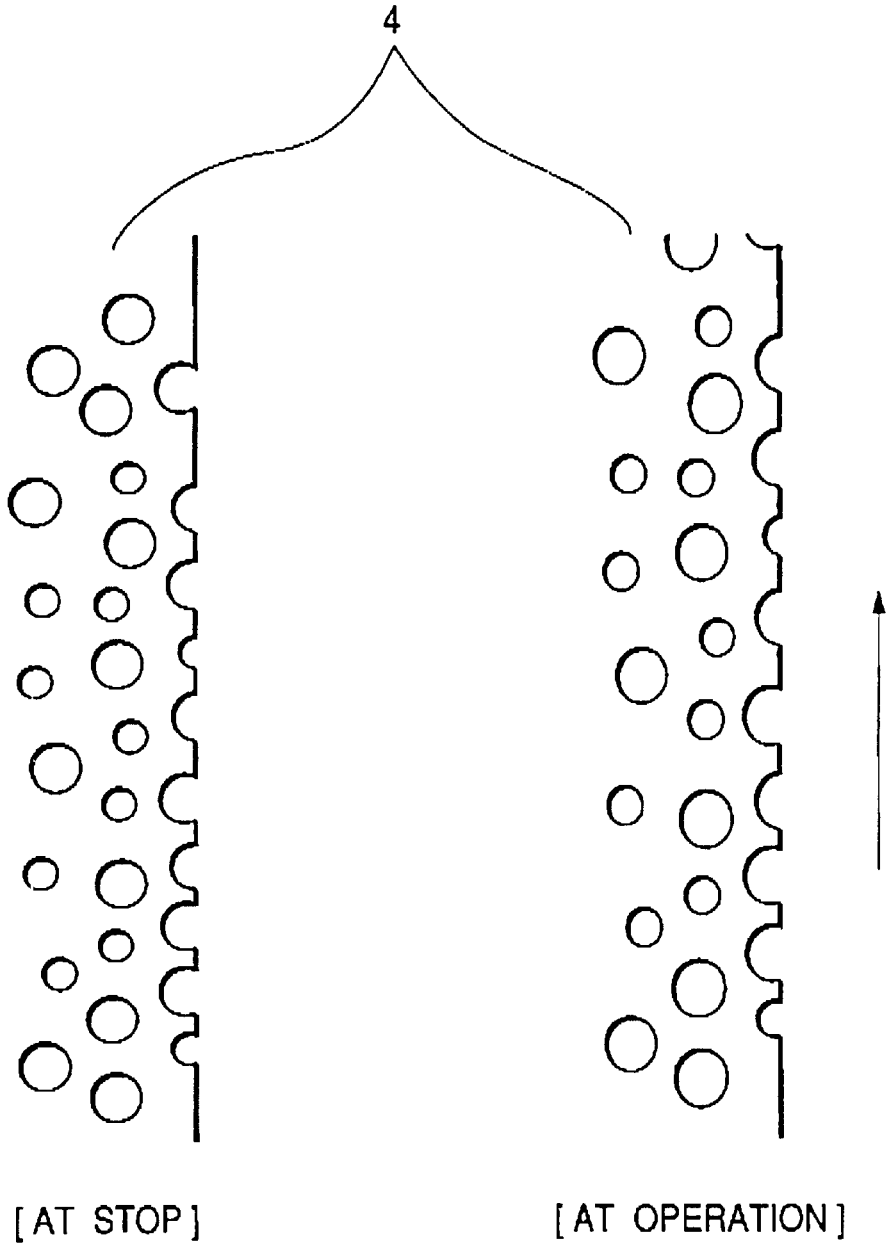
FIG. 23 shows the surface states of the toner supplying belt at stop and at operation in the developing device.

A sixth embodiment of a developing device according to the present invention will now be described with reference to the drawings. FIG. 21 is a schematic cross-sectional view of the developing device 1C according to the present embodiment, FIG. 22 shows the looped states of the toner supplying belt 4 at stop and at operation in the developing device 1C, and FIG. 23 shows the surface states of the toner supplying belt 4 at the stop and at the operation in the developing device 1C. The portions of the present embodiment which overlap those of the third embodiment in description are given the same reference characters and need not be described.

The present embodiment is a developing device 1C using developer carrying means using a toner supplying belt 4 and which is improved in the toner supplying capability. That portion of the toner supplying belt 4 which is moved to the developing sleeve 6 is tensioned so as to maximally extract the toner carrying force of the toner supplying belt 4, and the developer containing portion 5 is disposed so as to be adjacent to this portion.

Specifically, a plurality of belt looping rollers 2B, 3 supporting the toner supplying belt 4 are given a peripheral speed difference, whereby that portion of the toner supplying belt 4 which is moved to the developing sleeve 6 is tensioned.

In FIG. 21, the reference numerals 2B and 3 designate a first belt looping roller and a second belt looping roller, respectively, having an outer diameter of 12 mm. The first belt looping roller 2B and the second belt looping roller 3 are connected to the same motor through different gear trains, respectively, and the first belt looping roller 2B is rotatively moved at a peripheral speed of 120 mm/sec., and the second belt looping roller 3 is rotatively moved at a peripheral speed of 119.4 mm/sec. (−0.5% from the peripheral speed of the first belt looping roller 2B).

The first belt looping roller 2B and the second belt looping roller 3 have the toner supplying belt 4 extended therebetween, and the toner supplying belt 4 is rotated by the first belt looping roller 2B and the second belt looping roller 3.

(Operation)

Description will now be made of the operative state of the developing device 1C of the present embodiment. First, in a state in which the toner supplying belt 4 is stopped, the toner supplying belt 4 is held in its uniformly tensioned state by the elasticity thereof, irrespective of the looped shape of the toner supplying belt 4, as shown in FIG. 22, T STOP.

When the developing operation is started and the motor is rotated, the first belt looping roller 2B and the second belt looping roller 3 are rotated at the above-mentioned peripheral speeds, respectively. Since at this time, the first belt looping roller 2B is being rotated at a peripheral speed higher than the peripheral speed of the second belt looping roller 3, that area of the toner supplying belt 4 which faces the developer containing portion 5 and is upwardly moved is subjected to the tension by the peripheral speed difference of the second belt looping roller 3 and becomes somewhat pulled (see FIG. 22, "AT OPERATION").

On the other hand, at this time, that area of the toner supplying belt 4 which faces the developer containing portion 5 and extends from the looping portion of the first belt looping roller 2B to the looping portion of the second belt looping roller 3, that is, which is being downwardly moved, becomes somewhat slack.

When as shown in FIG. 23, the surface of that portion of the toner supplying belt 4 in such a rotated state which is being upwardly moved is enlarged, the toner supplying belt 4 is somewhat pulled and is in its tensioned state and therefore, pores provided in the surface layer thereof are prolonged and the opening portions of those pores become larger than at stop. Also, the transportation of the toner T by the toner supplying belt 4 is effected by the toner T coming into the pore portions and therefore, if the pores become larger, the toner carrying capability per unit rotation is also improved.

As described above, a peripheral speed difference is provided between the first belt looping roller 2B and the second belt looping roller 3 so as to tension the belt surface of the toner supplying belt 4 which faces the developer containing portion 5, whereby the carrying of the toner T can be effected at all times by that portion of the toner supplying belt 4 which is great in the toner carrying capability.

Simply to improve the toner carrying capability, it is also effective to make the size of the pores formed in the surface of the toner supplying belt 4 large. In this case, however, the opening portions of the pores become large and at the same time, the depth thereof also becomes great and therefore, it is difficult for the toner T to come into the inner parts of the pores and further, it is difficult for the toner T which has come into the inner parts of the pores to be discharged. Thus, the toner T may continue to remain in the inner parts of the pores on the toner supplying belt 4 to thereby cause bad development.

On the other hand, in the case of the construction of the present embodiment, only the opening portions of the pores are widened and the depth of the pores does not change and therefore, it becomes possible to achieve an improvement in the amount of supply of the toner T and at the same time, the toner T does not collect in the inner parts of the pores and therefore, it becomes possible to maintain good images.

Means for giving a peripheral speed difference to between the first belt looping roller 2B and the second belt looping roller 3 can also be realized by slightly changing the outer diameters of the two rollers, and a similar effect can be displayed.

Also, while in the present embodiment, description has been made of a case where the toner supplying belt 4 is looped by the use of two looping rollers 2B, 3, of course the number of the looping rollers can be three or more to obtain a similar effect.

As described above, in the present embodiment, the toner carrying capability can be improved without any additional member being newly required.

<Seventh Embodiment>

Figure 24:
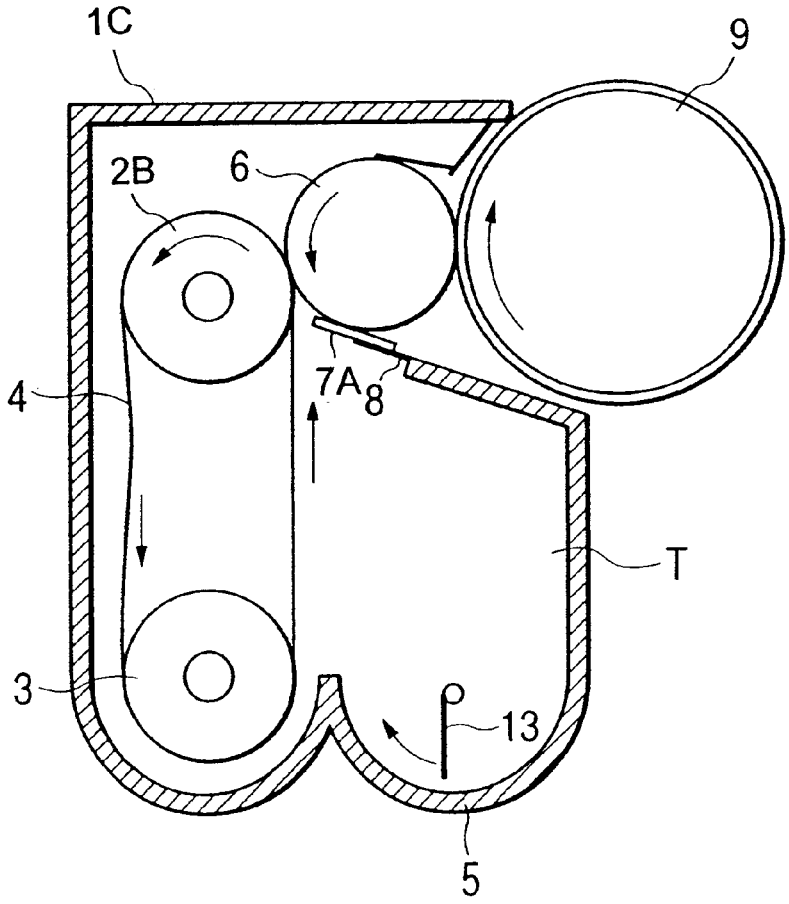
FIG. 24 is a schematic cross-sectional view of a developing device according to a seventh embodiment.

A seventh embodiment of a developing device according to the present invention will now be described with reference to the drawing. FIG. 24 is a schematic cross-sectional view of the developing device 1C of the present embodiment. The portions of the present embodiment which overlap those of the third embodiment in description are given the same reference characters and need not be described.

The feature of the present embodiment is that in a plurality of belt looping rollers 2B, 3 supporting the toner supplying belt 4, of the rollers 2B, 3 for looping the toner supplying belt 4, only the first belt looping roller 2B installed at a location most proximate to the developing sleeve 6 is provided with drive transmitting means, whereby that portion of the toner supplying belt 4 which is moved to the developing sleeve 6 is tensioned.

Thereby, by a construction simpler than that of the sixth embodiment, it is possible to improve the amount of supply of the toner T to the developing sleeve 6.

In FIG. 24, the reference numeral 2B designates the first belt looping roller, and the reference numeral 3 denotes the second belt looping roller, and the toner supplying belt 4 is looped by these two rollers. The first belt looping roller 2B is provided with a drive transmitting mechanism for receiving a driving force from a stepping motor, not shown, whereby the first belt looping roller 2B is rotatively driven. The toner supplying belt 4 is a single layer of foamed polyurethane foam having pores in the surface layer thereof.

On the other hand, the second belt looping roller 3 is rotatably journalled in parallel to the first belt looping roller 2B at a location whereat the toner supplying belt 4 is in such an appropriate looped state in which it is not slack and does not destroy the toner supplying belt 4 by a tensile force.

(Operation)

Description will now be made of the operative state of the developing device 1C of the present embodiment. When the stepping motor is rotated, the first belt looping roller 2B is rotatively driven to thereby rotate the toner supplying belt 4 in the direction of the arrow in FIG. 24. At this time, that area of the toner supplying belt 4 which faces the developer containing portion 5 and is being upwardly moved is subjected to the back tension of the second belt looping roller 3 and therefore becomes somewhat pulled.

In the developing device 1C of the present embodiment, design is made such that the belt surface facing the developer containing portion 5 is tensioned by the utilization of the back tension of the second belt looping roller 3, and by action similar to that described in the sixth embodiment, it is possible to effect the carrying of the toner T at all times by that portion of the toner supplying belt 4 which is tensioned and is great in toner carrying capability.

Also, the drive can be transmitted to only the first belt looping roller 2B and therefore, the present embodiment can be constructed more inexpensively as compared with the above-described sixth embodiment.

While in the present embodiment, description has been made of a case where the toner supplying belt 4 is looped by the use of two looping rollers, the number of the looping rollers can of course be three or more to thereby obtain a similar effect.

As described above, by adopting a developing device 1C construction which extracts the toner carrying capability of the toner supplying belt 4, it has become possible to improve the toner carrying capability.

<Eighth Embodiment>

Figure 25:
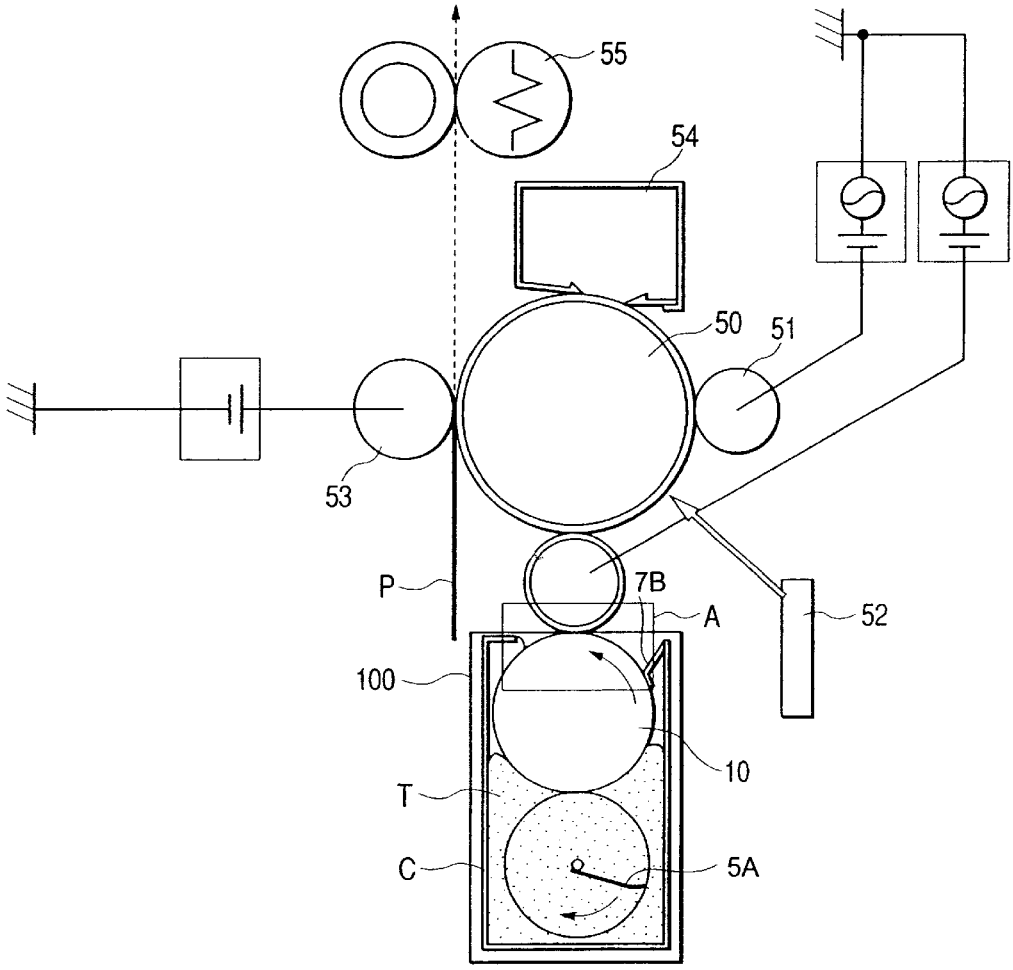
FIG. 25 is a schematic illustration of an image forming apparatus.
Figure 26:
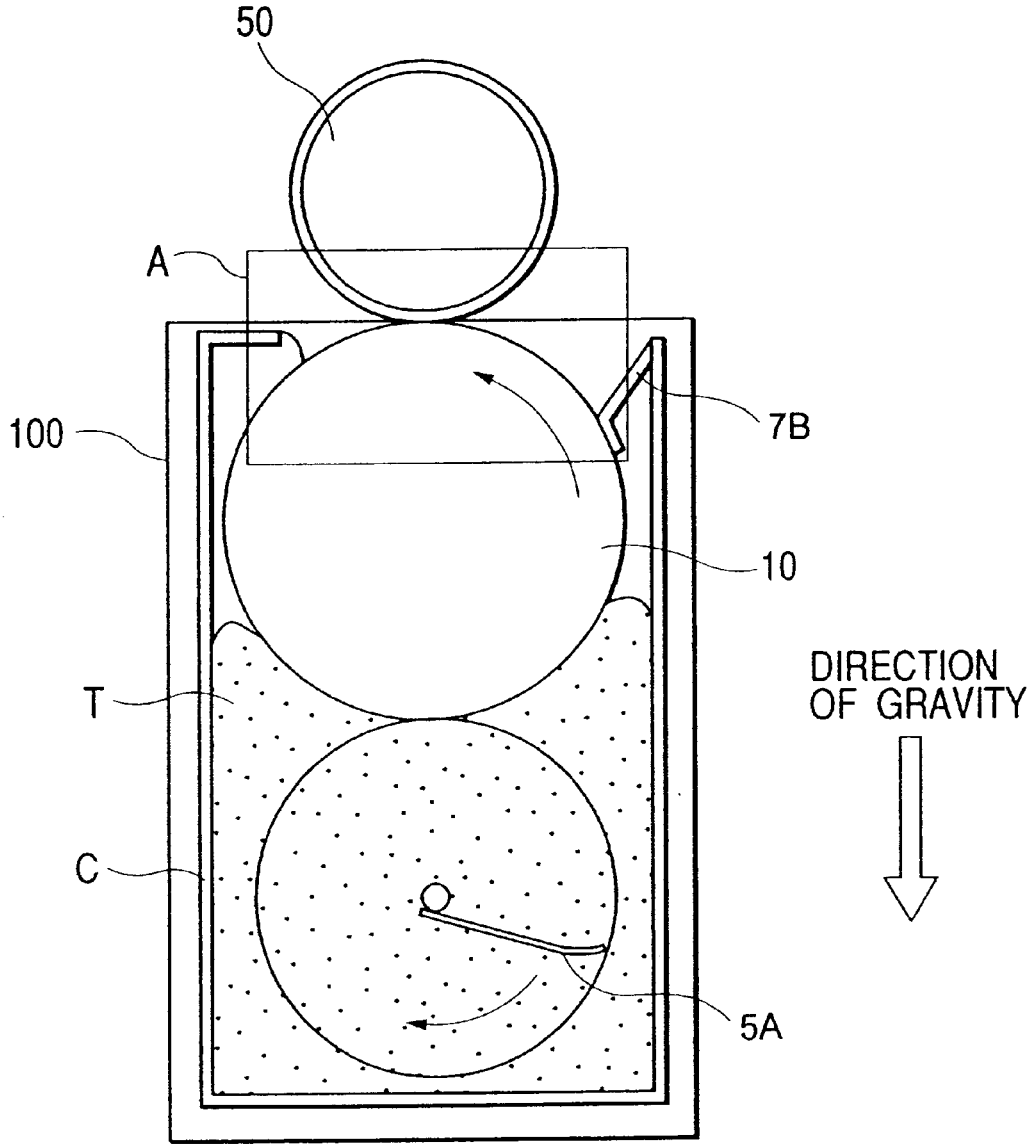
FIG. 26 is a cross-sectional view of a developing device according to an eighth embodiment.
Figure 27A:
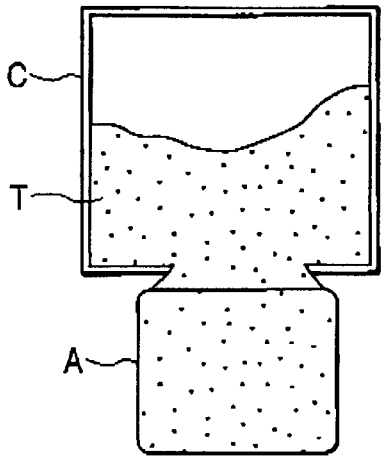
FIGS. 27A, 27B and 27C show the positional relationship between a developing portion and a toner container.
Figure 27B:
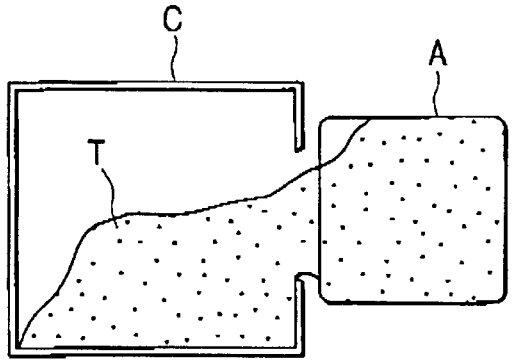
Figure 27C:
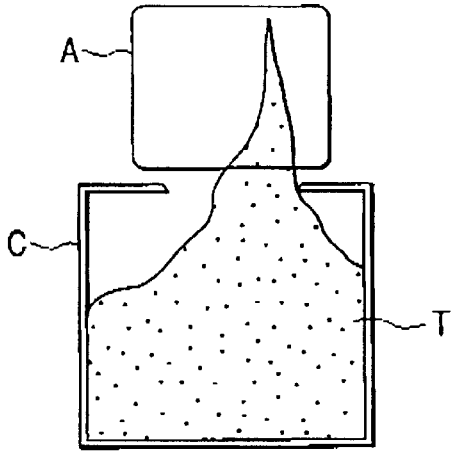

An eighth embodiment of the present invention will now be described with reference to the drawings. In the description, an image forming apparatus will first be schematically described, whereafter a developing device will be described in detail. FIG. 25 is a schematic illustration of the image forming apparatus, FIG. 26 is a cross-sectional view of the developing device according to an eighth embodiment, FIGS. 27A, 27B and 27C show the positional relationship between a developing portion and a toner container, and FIG. 28 is a table showing the result of an experiment in which the effect of the eighth embodiment was confirmed.

(Image Forming Apparatus)

As shown in FIG. 25, in the image forming apparatus, a usually drum-shaped electrophotographic photosensitive member (hereinafter shown as the photosensitive drum) 50 as an image bearing member is uniformly charged by a primary charger 51. Next, light is applied from an exposing device 52 onto the photosensitive drum 50 correspondingly to image information inputted from an external device to thereby form a latent image. This electrostatic latent image on the photosensitive drum 50 is made into a visible image, i.e., a toner image, by a developing device 100, by a developer (hereinafter shown as the toner) T having the same triboelectrification polarity as the polarity of a voltage applied to the primary charger 51.

The toner image is transferred to a transferring material P by a transferring charger 53. The transferring material P is separated from the photosensitive drum 50, and subsequently is conveyed to a fixing device 55, where the toner image on the transferring material P is fixed and thereafter becomes a permanent image. Also, any toner T not transferred by the transferring charger 53 but remaining on the photosensitive drum 50 is removed by a cleaning device 54, and the photosensitive drum 50 is used for the next image forming process.

(Developing Device)

The developing device 100 is a nonmagnetic monocomponent developing device to which the present invention is applied. The developing device 100 will hereinafter be described in detail. As shown in FIG. 26, a developing portion A for developing the electrostatic latent image on the photosensitive drum 50 as an image bearing member is disposed upwardly of a toner container C as a developer containing portion with respect to the direction of gravity. A roller 10 (hereinafter referred to as the DT roller) which is a developer bearing member serving both to carry the toner and to develop the electrostatic latent image exists between the developing portion A and the toner container C. A toner regulating member (toner layer thickness regulating member) 7B exists in the developing portion A, and the toner T as a developer and a toner agitating member 5A exist in the toner container C.

Each of the above-mentioned members will now be described.

As the DT roller 10, use is made of a urethane member of ϕ50 mm subjected to surface treatment. As the toner regulating member 7B, use is made of a phosphor bronze plate having a thickness of 0.1 mm, which abuts against the DT roller 10 with line pressure of 30 g/cm in a counter direction with respect to the direction of rotation of the DT roller 10. The toner T is a nonmagnetic negatively chargeable toner manufactured by the pulverizing method or the polymerizing method. As the toner agitating member 5A, PET film having a thickness of 0.3 mm is stuck on an SUS mandrel of ϕ3 mm.

The operation of the developing device 100 will now be described.

The toner T present in the toner container C is moved and supplied to the DT roller 10 by the toner agitating member 5A being clockwisely rotated as indicated by the arrow in FIG. 26. The supplied toner T on the DT roller 10 is carried to the developing portion A along the rotation of the DT roller 10.

The toner T on the DT roller 10 which has arrived at the developing portion A forms a thin layer by means of the toner regulating member 7B and at the same time, has appropriate charges imparted thereto. Thereafter, by a developing electric field by a developing bias applied to between the DT roller 10 and the photosensitive drum 50, the toner T adheres from the DT roller 10 to the electrostatic latent image on the photosensitive drum 50 to thereby visualize the latent image as a toner image. As the developing bias, use is made of a voltage controlled within the range of a DC voltage of 0V to −700V.

The effect in the developing device 100 of the eighth embodiment will now be specifically described.

The construction of the developing device 100 of the eighth embodiment is a construction in which the DT roller 10 which is a developer bearing member serves both to carry the toner T and to develop the electrostatic latent image, and effects the upward carrying of the toner T from the toner container C to the developing portion A.

FIGS. 27A, 27B and 27C show the modeled positional relationship among the developing portion A, the toner container C and the toner T due to the differences in the toner carrying direction. FIG. 27A shows a construction in which the downward carrying of the toner T from the toner container C to the developing portion A is effected, and FIG.

27B shows a construction having the horizontal carrying of the toner T from the toner container C to the developing portion A. FIG. 27C shows a construction which, as in the eighth embodiment, has the upward carrying of the toner T from the toner container C to the developing portion A.

When as shown in FIG. 27A, the developing portion A is downwardly of the toner container C, the carrying of the toner T from the toner container C to the developing portion A is effected by gravity and therefore, the construction for carrying the toner T becomes very simple. However, conversely, the carrying of the toner T from the developing portion A to the toner container C becomes very difficult. Therefore, the toner T carried to the developing portion A stays in the developing portion A, and the aforedescribed problem of the blowoff of the toner T is liable to arise.

When as shown in FIG. 27B, the developing portion A and the toner container C are in a horizontal direction, the carrying of the toner T from the toner container C to the developing portion A need be effected by any other force such as an agitating member than gravity. A necessary amount of toner T must always be carried to the developing portion A and thus, the flow of the toner T is always directed to the developing portion A. Accordingly, the toner. T carried to the developing portion A almost stays in the developing portion A. Thereupon, as in the case where the developing portion A is downwardly of the toner container C, the problem of the blowoff of the toner T is liable to arise.

When as shown in FIG. 27C, the developing portion is upwardly of the toner container C, the carrying of the toner T from the toner container C to the developing portion A is effected against gravity and is therefore difficult. However, the toner T present in the developing portion A is affected by gravity and therefore, the developing portion A is not clogged with the toner T. Accordingly, it is difficult for the problem of the blowoff of the toner T to arise.

Consequently, by adopting a construction in which the means for carrying the toner T has an upward carrying portion from the toner container C to the developing portion A, and a downward carrying portion from the developing portion A to the toner container C, namely, the construction of FIG. 27C, it is possible to prevent the blowoff of the toner T.

Here, description will be made of an experiment for confirming the effect of the developing device 100 of the present embodiment. As an experimental method, first in the developing device 100, the developing portion A and the toner container C were fixed in the directions of FIGS. 27A, 27B and 27C, respectively. Next, the DT roller 10 was rotated at predetermined numbers of revolutions. At this time, whether the leakage and blowoff of the toner T occurred around the developing portion A was visually confirmed. The aforementioned predetermined numbers of revolutions were 30 rpm, 50 rpm and 70 rpm, and the rotation time was two (2) hours. FIG. 28 shows the result of the above-described experiment. In this figure, 27A, 27B and 27C in the column of the arrangement of the developing device correspond to the respective arrangements of FIGS. 27A, 27B and 27C.

As shown in FIG. 28, in the cases of 27A and 27B, at 5:0 rpm and 70 rpm, the blow off of the toner T was confirmed between the DT roller 10 and the toner regulating member 7B, and from the end portions of the DT roller 10. However, in 27C which is the construction of the present embodiment, the blowoff or the like of the toner T from around the developing portion A was not confirmed.

In the developing device 100 of the present embodiment as described above, the developing portion is disposed upwardly of the toner container C, whereby the developing portion A is not clogged with the toner T. Therefore, it has become possible to prevent the leakage of the toner T from the developing portion A.

Also, the DT roller 10 which is a developer bearing member serving also as upward toner carrying means is formed between the toner container C and the developing portion A. Thereby, the simplification of the developing device 100 could be achieved, and the manufacturing cost could be restrained from becoming higher.

<Ninth Embodiment>

Figure 29:
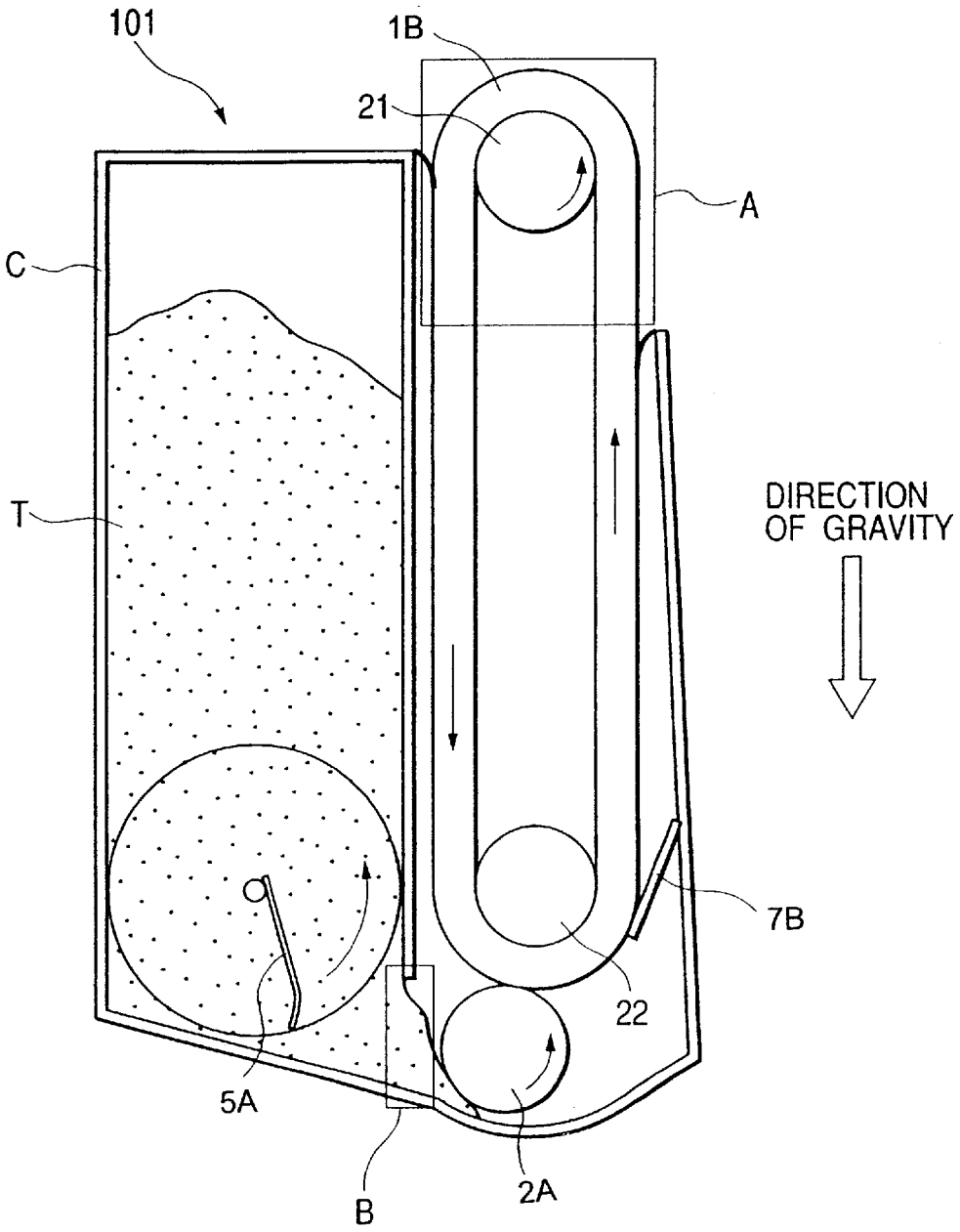
FIG. 29 is a cross-sectional view of a developing device according to a ninth embodiment.
Figure 30:
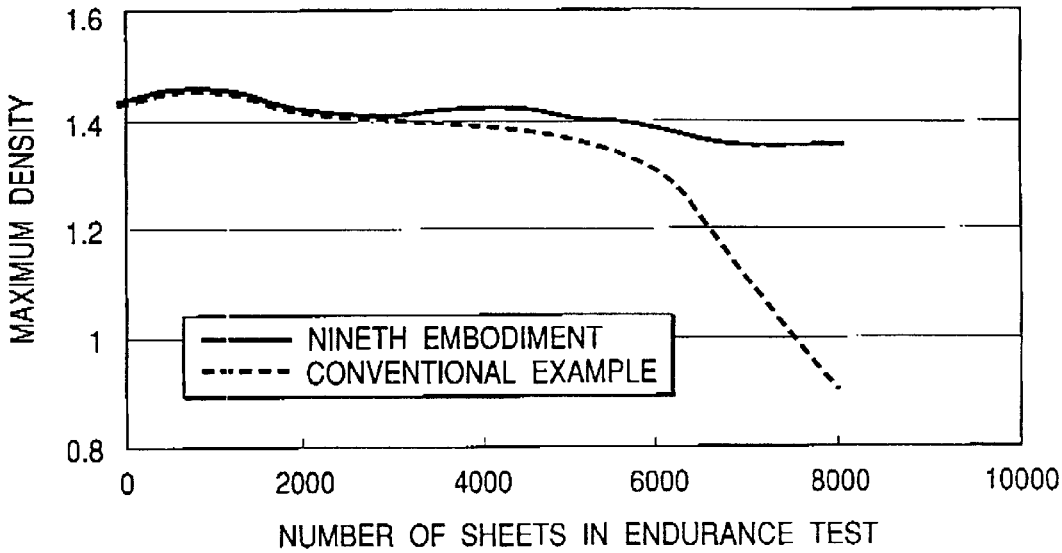
FIG. 30 shows the result of an experiment in which the effect of the ninth embodiment was confirmed.

A ninth embodiment of the present invention will now be described with reference to the drawings. FIG. 29 is a cross-sectional view of a developing device of the ninth embodiment, and FIG. 30 shows the result of an experiment in which the effect of the ninth embodiment was confirmed. The members of the present embodiment which are similar to those of the aforedescribed embodiments are given the same reference characters and need not be described. As shown in FIG. 29, the developing device 101 is a nonmagnetic monocomponent developing device to which the present invention is applied. The developing device 101 will hereinafter be described in detail.

In the developing device 101 of the ninth embodiment, an opening portion B is provided near the bottom of the toner container C, and the developing portion A is disposed upwardly of the opening portion B with respect to the direction of gravity. A belt member 1B (hereinafter referred to as the D belt) which is a developer bearing member serving both to carry the toner T and to develop the electrostatic latent image is provided between the developing portion A and the opening portion B. The D belt 1B is looped by two shafts, i.e., a drive roller 21 and a tension roller 22. The D belt 1B and the drive roller 21 exist in the developing portion A, and the toner T as a developer and a toner agitating member 5A exist in the toner container C. The supply of the toner onto the D belt 1B is effected in the opening portion B of the toner container C, and the tension roller 22, an RS roller 2A as a developer supplying and removing member, and a toner regulating member 7B exist therein.

Each member in the developing device 101 will first be described.

A urethane member subjected to surface treatment is used as the D belt 1B. As the toner regulating member 7B, use is made of a phosphor bronze plate having a thickness of 0.1 mm, which abuts against the D belt 1B with line pressure of 30 g/cm in a counter direction with respect to the direction of rotation of the D belt 1B. SUS rollers of $\phi$5 mm are used as the drive roller 21 and the tension roller 22. The toner T is a nonmagnetic negatively chargeable toner manufactured by the pulverizing method or the polymerizing method. As the RS roller 2A, use is made of polyurethane foam having a thickness of 5 mm and density of 0.025 g/cm$^2$ on SUS of $\phi$5 which is a shaft bar.

The operation of the developing device 101 will now be described.

The toner T present in the toner container C is moved to the opening portion B by the toner agitating member 5A being rotated in the direction of the arrow in FIG. 29. The toner T is supplied to the D belt 1B by the RS roller 2A in the opening portion B. Also, the D belt 1B is rotated in the direction of the arrow in FIG. 29, and the RS roller 2A is rotated in the direction of the arrow in FIG. 29 which is a counter direction with respect to the direction of rotation of the D belt 1B. The supplied toner T on the D belt 1 forms a thin layer by the toner regulating member 7B and at the same time, has appropriate charges imparted thereto.

The toner T on the D belt 1B which has arrived at the developing portion A moves from the D belt 1B to the electrostatic latent image on the photosensitive drum 50 by a developing electric field by a developing bias applied to between the D belt 1B and the photosensitive drum 50 to thereby visualize the latent image as a toner image. As the developing bias, use is made of a voltage controlled within the range of a DC voltage of 0 V to −700 V.

Any toner T which has not contributed to development in the developing portion A is carried along the movement of the D belt 1B from the developing portion A to the opening portion B of the toner container C. Thereafter, there is formed the toner circulation that the toner T is again supplied to the D belt 1B.

The effect in the developing device 101 of the ninth embodiment will now be specifically described.

First, like the eighth embodiment, the present embodiment is of a toner drawing-up construction in which the carrying of the toner T is effected against gravity and therefore, the blowoff of the toner T from the developing portion A can be reduced. Next, the developer bearing member serving both to carry the toner T and to develop the electrostatic latent image is in the form of a belt member or D belt 1B, whereby as compared with a case where a roller is used, it can be achieved to make the widthwise dimension of the toner carrying mechanism small. Therefore, the manufacturing cost can be restrained from becoming higher.

Next, by the D belt 1B which is a developer bearing member, the upward carrying portion from the opening portion B of the toner container C to the developing portion A and the downward carrying portion from the developing portion A to the opening portion B of the toner container C together form a developer circulating path. Thereby, the toner T frictionally contacted and having frictionally heat can be reliably carried toward the bottom of the developing device 101. Thus, the surface of the toner T which has generated heat obtains a sufficient radiating time, whereby it becomes possible to reduce the deterioration of the toner T which is a problem.

The effect of the D belt 1B will now be described. The developing device 101 of the ninth embodiment, as previously described, must effect the draw-up carrying of the toner T. When there is no unevenness on the surface of the D belt 1B, the toner T must be carried by only the adsorption force between the toner T and the D belt 1B. However, when the surface of the D belt 1B has unevenness, the toner T comes into concave portions, and this is very effective for the draw-up carrying of the toner T. Specifically, in the measurement by a surface roughness meter, the average of the differences between concave portions and convex portions may preferably be 3 $\mu$m to 50 $\mu$m. In the ninth embodiment, use is made of a D belt 1B having a surface rougness of 10 $\mu$m.

Also, an electrically conductive member is used as the D belt 1B, whereby the toner development of the photosensitive drum 50 using a developing bias is made possible. Even when an insulative member is used as the D belt 1B, the toner development of the photosensitive member 50 using a developing bias can be effected, but in that case, a charge eliminating member will need to be mounted on the D belt 1B.

Description will now be made of the effect about supporting members 21, 22 for the D belt 1B.

In the ninth embodiment, the D belt 1B is looped by two rollers 21, 22. The rollers 21, 22 are used to loop the D belt 1B, whereby the driving of the D belt 1B is made easy. The supporting members, however, may be other members than the rollers 21, 22, e.g. fixed supporting rods. In that case, the rods are inferior in driving performance to the rollers 21, 22, but the manufacturing cost can be suppressed. Also, by the drive roller 21 of the D belt 1B being disposed on the developing portion A side, it can be made adjacent to the drive gear of the photosensitive drum 50 and therefore, the manufacture can be made easy. The belt drive roller 21 may be in the toner containing portion C.

In order to describe the effect of the present invention, a comparing experiment for the developing device 101 of the ninth embodiment and the developing device 160 described in the related art was carried out. The comparing experiment measures the image density from the above-described two developing devices. The experimental method will hereinafter be described.

First, as the arrangements of the two developing devices, what is shown in FIG. 27C was utilized for the developing device 101 and what is shown in FIG. 27B was utilized for the conventional developing device. Next, a photosensitive drum, charging means, exposing means, transferring means and fixing means were disposed in each of the developing devices. The photosensitive drum is charged to −650 V by the charging means, and the surface of the photosensitive drum is exposed by a laser having a quantity of light of 3.0 mJ/m$^2$ to thereby form an electrostatic latent image on the photosensitive drum. This electrostatic latent image is visualized as a toner image by a developing electric field by a developing bias. As the developing bias, use is made of a voltage controlled within the range of a DC voltage of 0 V to −700 V. This toner image is transferred to a transferring material by the transferring means, and is fixed by the fixing means. The photosensitive drum has a diameter of 24 mm, and had a peripheral speed difference of 170% with respect to the D belt and the developing roller in the developing device. At this time, the process speed of the D belt and the developing roller is 160 mm/sec. Also, the maximum amount of toner fitting each of the developing device 101 and the conventional developing device 160 is 200 g, and corresponds to about 8,000 sheets when images of 4% coverage rate are outputted.

FIG. 30 shows the result of an experiment in the developing device 101 and the result of an experiment in the developing device 160 described in the related art. FIG. 30 shows the relation between the number of sheets in an endurance test and maximum density in each developing device. In this case, the toner container was filled with an amount of toner for 8,000 sheets in an endurance test, images of coverage rate of 4% were outputted, and solid images of 30×30 mm were outputted for each 1,000 sheets. The density of the solid images was measured from a density measuring device using reflected light.

In FIG. 30, the solid line indicates the result of the developing device 101, and the broken line indicates the result of the conventional developing device 160. As shown in FIG. 30, in the conventional developing device 160, the maximum density suddenly lowers from 6,000 sheets in the endurance test. In the developing device 101, however, it will be seen that the density is maintained for up to the latter half of the endurance test. That is, the lowering of density can be mitigated by the present invention. This means that the deterioration of the toner is reduced.

Also, description will be made of a countermeasure for the leakage of the toner from the developing portion which was used in the above-described experiments. In the conventional developing device 160, moltopren having a thickness of 5 mm was stretched around the end portions of the developing roller. In contrast, in the developing device 101, moltopren having a thickness of 2 mm was merely used around the opening portion of the toner containing portion.

When the two developing devices were observed after the termination of the experiments, the leakage of some toner was confirmed from the end portions of the conventional developing device 160. However, the leakage of the toner was not confirmed from the developing device 101.

In the monocomponent developing device of the present embodiment as described above, the D belt 1B which is a developer bearing member serving also as toner carrying means is formed between the toner container C and the developing portion A. Thereby, it becomes possible to carry the toner T to the developing portion A by only a necessary amount, and the toner T once frictionally contacted and having frictional heat can be reliably carried to the toner container C. Therefore, the surface of the toner T which has generated heat obtains a sufficient radiating time and is cooled, whereby the deterioration of the toner T can be reduced. Also, it never happens that the widthwise dimension of the toner carrying mechanism becomes larger and therefore, the widthwise narrowing of the developing device can be achieved.

Further, in the developing device 101 of the present embodiment, the developing portion A is disposed upwardly of the toner container C and therefore the developing portion A is not clogged with the toner T. Therefore, it has become possible to prevent the leakage of the toner T from the developing portion A.

<Tenth Embodiment>

Figure 31:
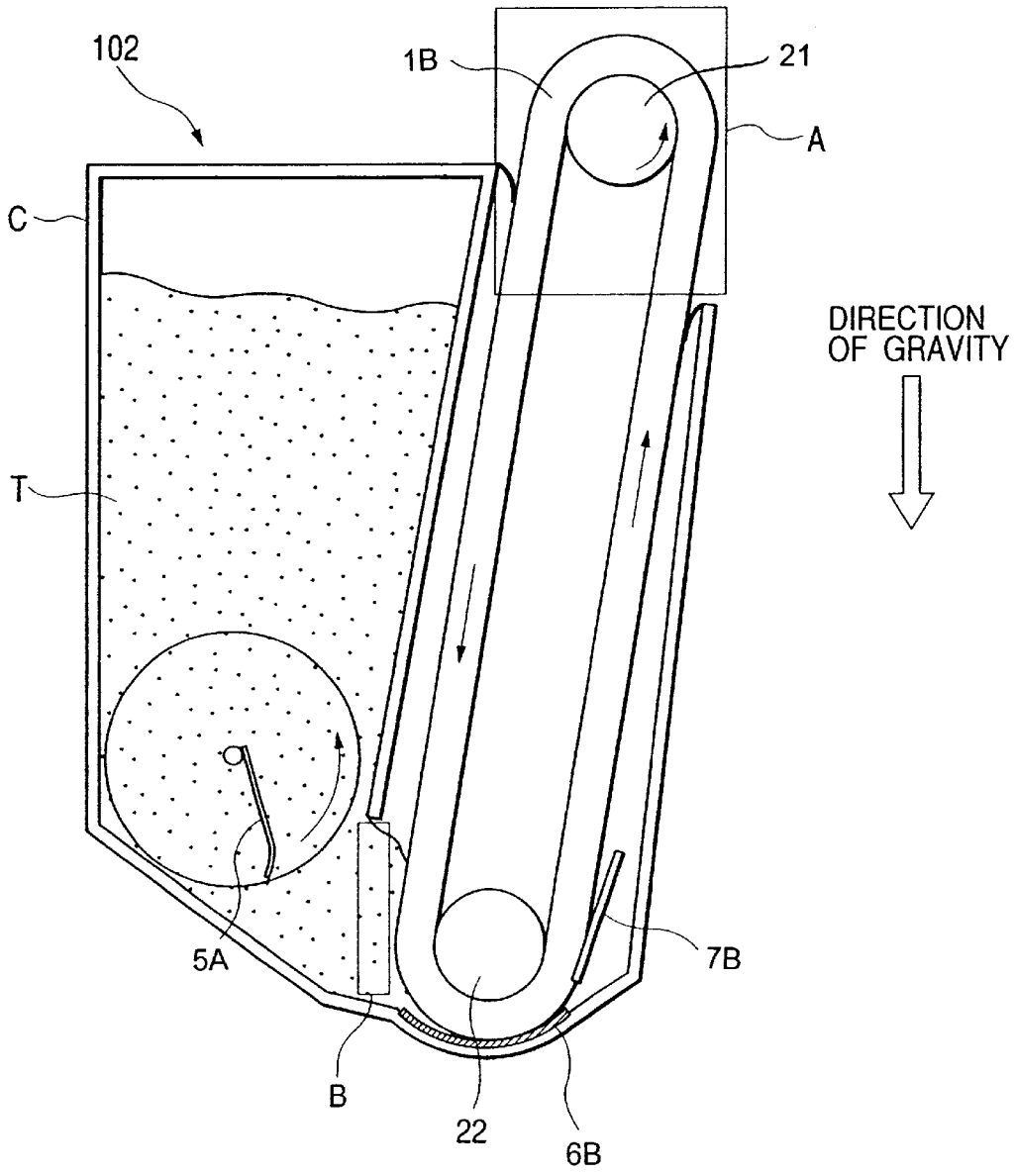
FIG. 31 is a cross-sectional view of a developing device according to a tenth embodiment.
Figure 32:
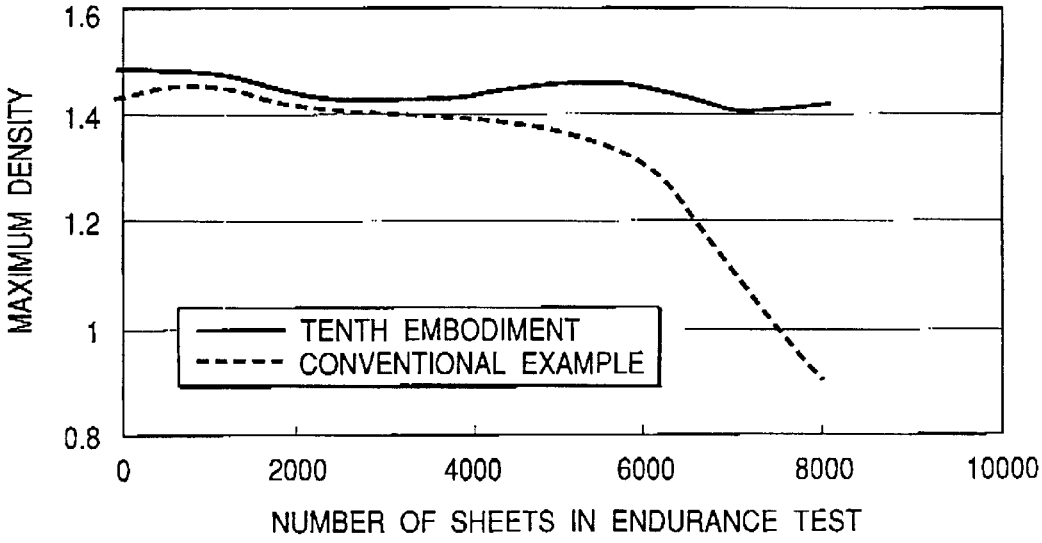
FIG. 32 shows the result of an experiment in which the effect of the tenth embodiment was confirmed.

A tenth embodiment of the present invention will now be described with reference to the drawings. FIG. 31 is a cross-sectional view of a developing device according to the tenth embodiment, and FIG. 32 shows the result of an experiment in which the effect of the tenth embodiment was confirmed. The members of the present embodiment similar to those of the aforedescribed embodiment are given the same reference characters and need not be described. As shown in FIG. 31, the developing device 102, as in the eighth embodiment, is a nonmagnetic monocomponent developing device to which the present invention is applied. The developing device 102 will hereinafter be described in detail.

In the tenth embodiment, in the supply of the toner T to a belt member 1B (hereinafter referred to as the D belt) which is a developer bearing member serving both to upwardly carry the toner T and to develop an electrostatic latent image, a toner supplying roller is not used, but the supply of the toner onto the D belt 1B is effected by the action of an electric field.

In FIG. 31, the developing portion A is disposed obliquely upwardly of the opening portion B of the toner container C with respect to the direction of gravity. The D belt 1B exists between the developing portion A and the opening portion B of the toner container C. The D belt 1B is looped by two shafts, i.e., the drive roller 21 and the tension roller 22. The D belt 1B and the drive roller 21 exist in the developing portion A, and the toner T as a developer and a toner agitating member 5A exist in the toner container C. The tension roller 22, an electrode member 6B and a toner regulating member 7B exist near the opening portion B of the toner container C.

The electrode member 6B in the developing device 102 will first be described.

An aluminum sheet having a thickness of 0.2 mm is used as the electrode member 6B. Lamination of 0.1 mm which is an insulating member was effected on the surface of the electrode member 6B. The electrode member 6B is disposed on the bottom of the developing device 102 and is given a curvature along the bend of the D belt 1B.

The operation of the developing device 102 will hereinafter be described.

The toner T present in the toner container C is moved to the opening portion B by the toner agitating member 5A. In the opening portion B, an AC voltage of 1500 V is applied between the electrode member 6B and the tension roller 22. At this time, an electric field is created between the D belt 1B and the electrode member 6B. With it, the toner T present therebetween is vibrated. At this time, the D belt 1B is being rotated in the direction of the arrow in FIG. 31 and therefore, it becomes easy for the vibrated toner T to come into the uneven portions of the surface of the D belt 1B. That is, a sufficient amount of toner T is supplied to the D belt 1B. The supplied toner T on the D belt 1B forms a thin layer by the toner regulating member 7B and at the same time, has appropriate charges imparted thereto.

The toner T on the D belt 1B which has arrived at the developing portion A moves from the D belt 1B to the latent image on a photosensitive drum 50 by a developing electric field by a developing bias applied between the D belt 1B and the photosensitive drum 50, to thereby visualize the latent image as a toner image. As the developing bias, use is made of a voltage controlled within the range of a DC voltage of 0 V to −700 V.

Any toner T not used for development in the developing portion A is carried along the movement of the D belt 1B from the developing portion A to the opening portion B of the toner container C. Thereafter, it forms the toner circulation that the toner T is again supplied to the D belt 1B.

The effect of the developing device 102 of the tenth embodiment will be described here.

Since the supply of the toner T to the D belt 1B is effected by the action of the electric field, it has become possible to eliminate the RS roller 2A (see FIG. 29). Thus, the gear for transmitting drive to the RS roller 2A is also eliminated and therefore, the downsizing of the developing device 102 accompanying the simplification thereof has become realizable.

In the developing device 102 of the tenth embodiment, an experiment similar to that in the ninth embodiment was carried out. The comparison between the result of the experiment in the developing device 102 and the result of the experiment in the developing device 160 described in the related art will be shown below. The experimental apparatus is similar to that in the ninth embodiment and therefore need not be described.

FIG. 32 shows the relation between the number of sheets in an endurance test and the maximum density. In FIG. 32, the solid line indicates the result of the developing device 102 of the tenth embodiment, and the broken line indicates the result of the conventional developing device 160. As shown in FIG. 32, in the conventional developing device 160, the maximum density suddenly falls from 6,000 sheets in the endurance test. In the developing device 102 of the tenth embodiment, however, it will be seen that the density is maintained up to the latter half of the endurance test. That is, the fall of the density can be mitigated by the present invention. This means that the deterioration of the toner is reduced.

Also, the respective developing devices after the endurance test were observed with a result that the leakage of the toner was confirmed from the end portions of the developing roller of the conventional developing device. In the developing device 102, however, the leakage of the toner T from the developing portion A did not occur.

In the monocomponent developing device 102 of the present embodiment as described above, the developing portion A is disposed upwardly of the toner container C. The D belt 1B which is a developer bearing member serving also as toner carrying means is formed between the opening portion B of the toner container C and the developing portion A. Thus, it becomes possible to carry the toner T to the developing portion A by a necessary amount, and the toner T once frictionally contacted and having frictional heat can be reliably carried to the toner container C. Therefore the surface of the toner T which has generated heat obtains a sufficient radiating time and is cooled. As a result, the deterioration of the toner T could be reduced.

Also, in the developing device 102, the developing portion A is disposed upwardly of the toner container C and therefore, the developing portion A is not clogged with the toner T. Therefore, it has become possible to prevent the leakage of the toner T from the developing portion A.

Further, the supply of the toner T to the D belt 1B is effected by the action of the electric field and therefore, it has become possible to eliminate the RS roller 2A (see FIG. 29). Thus, the stress of the toner T occurring between the developer bearing member and the RS roller 2A becomes null and the deterioration of the toner T can be reduced. Further, the gear for transmitting drive to the RS roller 2A is also eliminated and therefore, the downsizing of he developing device accompanying the simplification thereof has become realizable.

<Eleventh Embodiment>

Figure 33:
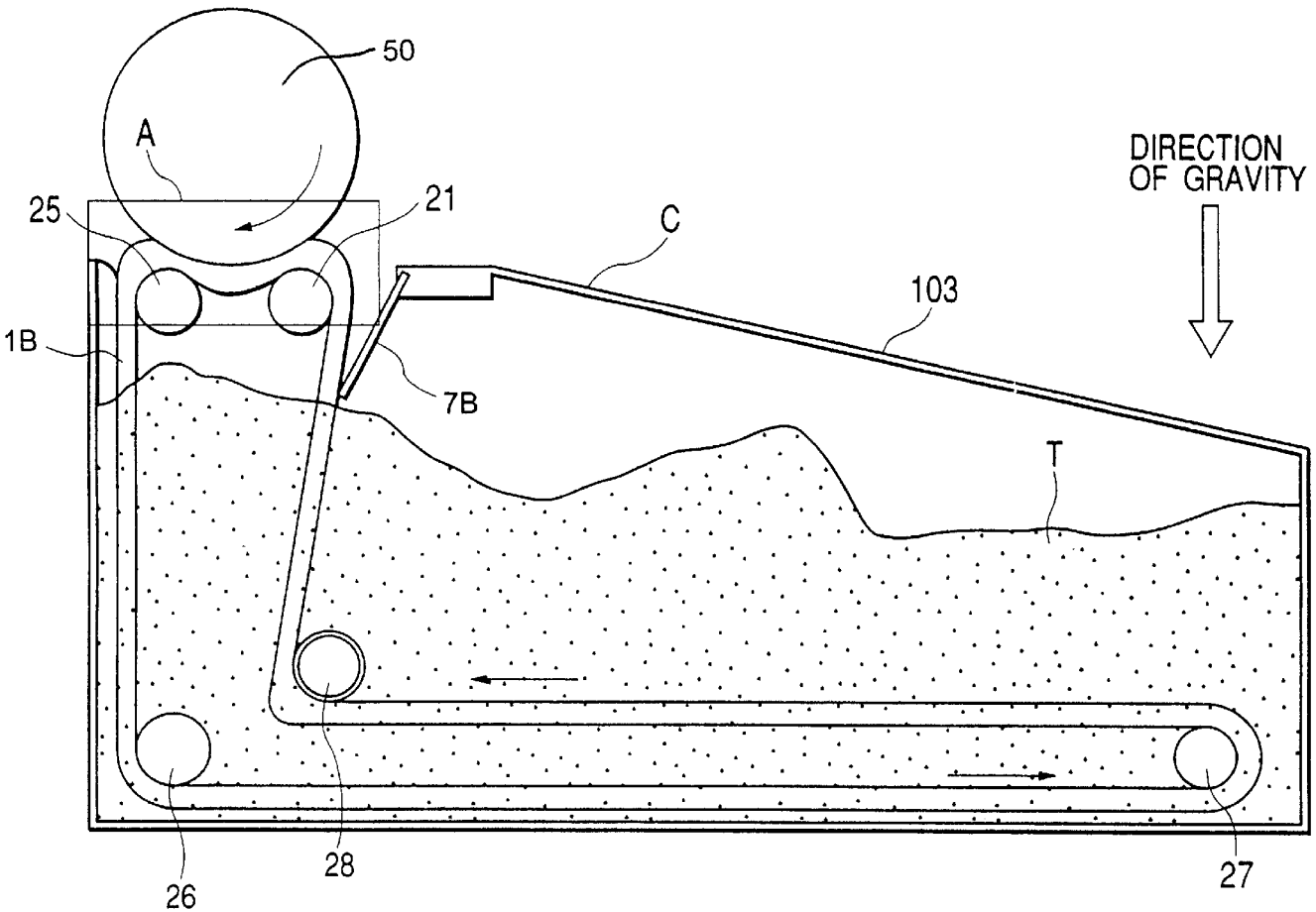
FIG. 33 is a cross-sectional view of a developing device according to an eleventh embodiment.
Figure 34:
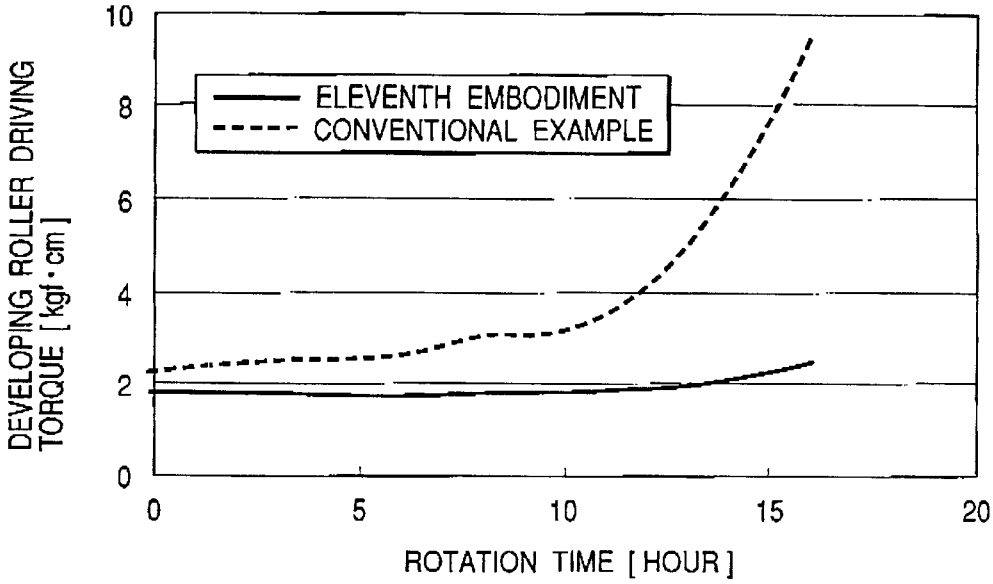
FIG. 34 shows the result of an experiment in which the effect of the eleventh embodiment was confirmed.

An eleventh embodiment of the present invention will now be described with reference to the drawings. FIG. 33 is a cross-sectional view of a developing device according to the eleventh embodiment, and FIG. 34 shows the result of an experiment in which the effect of the eleventh embodiment was confirmed. The members of the present embodiment which are similar to those of the aforedescribed embodiments are given the same reference characters and need not be described. As shown in FIG. 33, the developing device 103, as in the eighth to tenth embodiments, is a nonmagnetic monocomponent developing device to which the present invention is applied. The developing device 103 will hereinafter be described in detail.

The developing device 103 of the eleventh embodiment is a developing device in which a belt member 1B (hereinafter referred to as the D belt) is looped by a plurality of rollers. As a feature thereof, it is of a construction in which the D belt 1B is placed in the toner container C and further, the area of contact between the photosensitive drum 50 which is an image bearing member and the D belt 1B is increased.

The developing device 103 will hereinafter be described in detail.

In the developing portion A, there are disposed a drive roller 21, a first tension roller 25, the photosensitive drum 50 and a toner regulating member 3. In the toner containing portion C, there are disposed second, third and fourth tension rollers 26, 27 and 28. The D belt 1B is stretched by the above-mentioned rollers, and the D belt 1B is extended over the entire bottom surface of the toner container C. As the drive roller 21 and the first, second and third tension rollers 25, 26, 27, use is made of SUS rollers of $\phi$5 mm. As the fourth tension rollers 28, use is made of an SUS roller of $\phi$5 mm having stuck thereon a urethane member subjected to surface treatment and having a thickness of 2 mm. Also, the second, third and fourth tension rollers 26, 27, 28 are disposed near the bottom of the toner container C and soak in the toner T.

The operation of the developing device 103 will be described here.

The D belt 1B is rotated in the direction of the arrow in FIG. 33. Since the D belt 1B is disposed at the bottom of the toner container C, the toner T is moved on the D belt 1B by the action of gravity. The toner T is reliably supplied onto the D belt 1B by the fourth tension roller 28, and the toner T on the D belt is carried to the developing portion A.

The toner T carried to the developing portion A forms a thin layer by the toner regulating member 7B and at the same time, has appropriate charges imparted thereto. Then, the toner T moves from the D belt 1B to the latent image on the photosensitive drum 50 by a developing electric field by a developing bias applied to between the D belt 1B and the photosensitive drum 50 to thereby visualize the latent image as a toner image. As the developing bias, use is made of a voltage controlled within the range of a DC voltage of 0 V to −700 V.

Any toner T which has not contributed to development in the developing portion A is carried along the movement of the D belt 1B from the developing portion A to the bottom of the toner container C. Thereafter, it forms the toner circulation that it is again supplied to the D belt 1B.

The effects in the developing device 103 of the eleventh embodiment will now be specifically described.

The developing device 103, like the developing devices 100, 101 and 102 of the eighth to tenth embodiments, effects the upward carrying of the toner T from the toner container C to the developing portion A, and uses a developer bearing member using a belt member 1B. Therefore, a reduction in the deterioration of the toner T and a reduction in the leakage of the toner T from the developing portion A have become realizable.

There are chiefly two effects peculiar to the developing device 103. Those effects will be shown below. A first effect is that the D belt 1B is disposed over the entire bottom of the toner container C and therefore it has become possible to eliminate the agitating member. Thus, the transmission gear to the agitating member can be eliminated and the downsizing of the developing device resulting therefrom becomes realizable. A second effect is a reduction in the torque of the developing device. This is owing to the fact that the abutting with light pressure has become possible due to the elimination of the agitating member, and an increase in the area of contact between the photosensitive drum 50 and the D belt 1B.

The result of an experiment on the developing device 103 and the conventional developing device 160 regarding the torque of the developing device is shown in FIG. 34. As shown in FIG. 34, this experiment is such that the developing device was fitted with 50 g of toner and the torque of the developing device when the D belt 1B and the developing roller were rotated at a rotational speed of 160 mm/sec. was measured by an idle rotation measuring device. Also, in the developing device 103 of the eleventh embodiment, a D belt driving gear and a photosensitive drum driving gear are connected together. In the conventional developing device 160, a developing roller driving gear is connected to a photosensitive drum driving gear and an agitating member driving gear.

In FIG. 34, the solid line indicates the result of the developing device 103 of the eleventh embodiment, and the broken line indicates the result of the conventional developing device 160. First, at the initial stage of rotation, the torque of the developing device 103 is low as compared with the torque of the conventional developing device 160. This is considered to be a difference in the abutting pressure of the photosensitive drum, and it will be seen that in the developing device 103, the abutting is under light pressure.

Next, in the latter half of the idle rotation time, the driving torque of the conventional developing device 160 suddenly increases from ten (10) hours after. This is because the toner continues to be sent to the developing portion by the agitating member and the developing portion becomes full of the toner, and the toner clogs in the RS roller and the frictional force thereof with the developing roller increases. In the developing device 103 of the eleventh embodiment, however, an increase in torque scarcely occurred.

In the monocomponent developing device of the present embodiment as described above, the developing portion A is disposed upwardly of the toner container C. The D belt 1B which is a developer bearing member serving also as toner carrying means is formed between the optioning portion of the toner container C and the developing portion A. Thus, it becomes possible to carry the toner T to the developing portion A by a necessary amount, and the toner T once frictionally contacted and having frictional heat can be reliably carried to the toner container C. Therefore, the surface of the toner T which has generated heat obtains a sufficient radiating time and is cooled. As a result, the deterioration of the toner T could be reduced.

Also, in the developing device 103 of the present embodiment, the developing portion A is disposed upwardly of the toner container C and therefore, the developing portion A is not clogged with the toner T. Therefore, it has become possible to prevent the leakage of the toner T from the developing portion A.

Further, since the D belt 1B is disposed over the entire bottom of the toner container C, it has become possible to eliminate the agitating member. Thus, the transmission gear to the agitating member can be eliminated, and the downsizing of the developing device 103 resulting therefrom becomes realizable. A reduction in the torque of the developing device 103 has become realizable owing to the light pressure abutting due to the elimination of the agitating member and an increase in the area of contact between the photosensitive drum 50 and the D belt 1.

(Other Embodiments)

While in the aforedescribed embodiments, a monochromatic printer has been illustrated and described as the image forming apparatus by way of example, this is not restrictive, but the image forming apparatus can also be utilized as a color printer using a plurality of developing devices according to the present invention, and the image forming apparatus is not restricted to a printer, but may be a facsimile apparatus or a copying machine.

Although various minor changes and modifications might be proposed by those skilled in the art, it will be understood that our wish is to include within the claims of the patent warranted hereon all such changes and modifications as reasonably come within our contribution to the art.

What is claimed is:

1. A developing device comprising:

a housing;

a developer bearing member rotatably provided in an opening portion of said housing;

a developer containing chamber; and a developer supplying and removing member being in contact with said developer bearing member, and having a function of supplying a developer in said developer containing chamber to said developer bearing member and a function of removing the developer from said developer bearing member, wherein said developer bearing member is disposed above said developer containing chamber, wherein said developer supplying and removing member has a function of upwardly carrying the developer from within said developer containing chamber, wherein said developer supplying and removing member includes a belt for bearing the developer thereon, said belt being made of a polyurethane foam material.

2. A developing device according to claim 1, further comprising a regulating member for regulating a layer thickness of the developer borne on said developer bearing member, wherein a portion of said developer containing chamber, which is immediately beneath said regulating member, is wide.

3. A developing device comprising:

a housing;

a developer bearing member rotatably provided in an opening portion of said housing;

a developer containing chamber; and a developer supplying and removing member being in contact with said developer bearing member, and having a function of supplying a developer in said developer containing chamber to said developer bearing member and a function of removing the developer from said developer bearing member, wherein said developer bearing member is disposed above said developer containing chamber, wherein said developer supplying and removing member has a function of upwardly carrying the developer from within said developer containing chamber, wherein said developer supplying and removing member includes a belt for bearing the developer thereon, wherein said belt includes an upwardly moved first area and a downwardly moved second area, and wherein tension applied to the first area and tension applied to the second area differ from each other.

4. A developing device according to claim 3, wherein the tension applied to the first area is greater than the tension applied to the second area.

* * * * *

UNITED STATES PATENT AND TRADEMARK OFFICE

CERTIFICATE OF CORRECTION

PATENT NO. : 6,738,593 B2
DATED : May 18, 2004
INVENTOR(S) : Takeshi Kawamura et al.

It is certified that error appears in the above-identified patent and that said Letters Patent is hereby corrected as shown below:

Drawings,
Sheet S24, “NINETH” should read -- NINTH --.

Column 1,
Line 22, “correspondingly” should read -- corresponding --; and “inputted” should read -- input --.

Column 2,
Line 31, “stainless!steel” should read -- stainless steel --.

Column 6,
Line 2, “correspondingly” should read -- corresponding --;
Line 23, “a RS belt” should read -- an RS belt --; and
Line 34, “member SB” should read -- member 5B --.

Column 7,
Line 13, “to” should read -- into --.

Column 8,
Line 14, “blow” should read -- blow off --.

Column 9,
Line 8, “stabler” should read -- more stable --; and
Line 56, “roller 1AA” should read -- roller 1A. A --.

Column 10,
Line 49, “shaft” should read -- shafts --.

Column 12,
Line 19, “are” should read -- is --; and
Line 60, “comparative” should read -- Comparative --.

Column 14,
Line 20, “impacts” should read -- imparts --.

UNITED STATES PATENT AND TRADEMARK OFFICE

CERTIFICATE OF CORRECTION

PATENT NO. : 6,738,593 B2
DATED : May 18, 2004
INVENTOR(S) : Takeshi Kawamura et al.

It is certified that error appears in the above-identified patent and that said Letters Patent is hereby corrected as shown below:

Column 17,
Line 39, “from” should read -- by --.

Column 18,
Line 14, “opposite,to” should read -- opposite to --.

Column 20,
Line 67, “journalled” should read -- journaled --.

Column 21,
Line 54, “correspondingly” should read -- corresponding --.

Column 22,
Line 47, “to” should be deleted.

Column 23,
Line 20, “such as an agitating member than gravity.” should read -- than gravity, such as an agitating member. --;
Line 23, “toner. T” should read -- toner T --;
Line 26, “downwardly” should read -- downward --;
Line 29, “upwardly” should read -- upward --; and
Line 59, “5:0” should read -- 50 --.

Column 24,
Lines 1 and 26, “upwardly” should read -- upward --; and
Line 65, “D belt 1” should read -- D belt 1B --.

Column 25,
Line 34, “frictionally” (second occurrence) should read -- frictional --; and
Line 53, “rougness” should read -- roughness --.

Column 31,
Line 6, “from ten (10) hours after.” should read -- after ten (10) hours --;
Line 9, “RS roller” should read -- RS roller, --;
Line 27, “upwardly” should read -- upward --; and
Line 41, “D belt 1.” should read -- D belt 1B. --.

UNITED STATES PATENT AND TRADEMARK OFFICE

CERTIFICATE OF CORRECTION

PATENT NO. : 6,738,593 B2
DATED : May 18, 2004
INVENTOR(S) : Takeshi Kawamura et al.

It is certified that error appears in the above-identified patent and that said Letters Patent is hereby corrected as shown below:

Column 32,
Line 17, "chamber," should read -- chamber, and --.

Signed and Sealed this

Nineteenth Day of October, 2004

JON W. DUDAS
*Director of the United States Patent and Trademark Office*